US007928302B2

(12) United States Patent
Sandson

(10) Patent No.: US 7,928,302 B2
(45) Date of Patent: Apr. 19, 2011

(54) COMPACT DRUM SET AND METHODS OF USING, SETTING UP, AND COMPACTING SAME

(76) Inventor: Daniel Lawrence Sandson, Del Mar, CA (US)

( * ) Notice: Subject to any disclaimer, the term of this patent is extended or adjusted under 35 U.S.C. 154(b) by 134 days.

(21) Appl. No.: 12/545,736

(22) Filed: Aug. 21, 2009

(65) Prior Publication Data

US 2010/0043622 A1 Feb. 25, 2010

Related U.S. Application Data

(60) Provisional application No. 61/091,533, filed on Aug. 25, 2008.

(51) Int. Cl.
*G10D 13/04* (2006.01)

(52) U.S. Cl. ..... 84/411 R

(58) Field of Classification Search ..... 84/411 R, 84/421

See application file for complete search history.

(56) References Cited

U.S. PATENT DOCUMENTS

| | | | |
|---|---|---|---|
| 3,433,115 | A | 3/1969 | Kjelstrom |
| 4,300,437 | A | 11/1981 | Hinger et al. |
| 6,150,594 | A | 11/2000 | Fiondella et al. |
| 6,211,448 | B1 | 4/2001 | Shigenaga et al. |
| 6,462,262 | B2 | 10/2002 | Hagiwara |
| 2005/0268772 | A1* | 12/2005 | Schaff ..... 84/421 |

FOREIGN PATENT DOCUMENTS

| | | |
|---|---|---|
| JP | 57-185487 | 11/1982 |
| JP | 11-352957 | 12/1999 |
| JP | 2007-256626 | 10/2007 |

OTHER PUBLICATIONS

Gigpig. Website printout, www.gigpig.org, Oct. 2007 (date of first knowledge of website), 1 page.

Cocktail Drums. Website printout, www.cocktaildrum.com, Sep. 2007 (date of first knowledge of website), 1 page.

Quarter Wave. Website printout, www.quarter-wave.com, Oct. 2008 (date of first knowledge of website), 1 page.

International Search Report and Written Opinion for PCT/US2009/054733 issued Apr. 12, 2010, 12 pages.

* cited by examiner

*Primary Examiner* — Kimberly R Lockett

(57) ABSTRACT

A compact transportable drum set includes a bass drum; a snare drum; at least one tom drum; at least one cymbal; and a throne. The compact transportable drum set is compactable to a compact transportable single package with the bass drum, the snare drum, at least one tom drum, at least one cymbal, and the throne vertically aligned and defining an envelope volume less than 8 cubic feet and weighing less than 60 lbs.

20 Claims, 31 Drawing Sheets

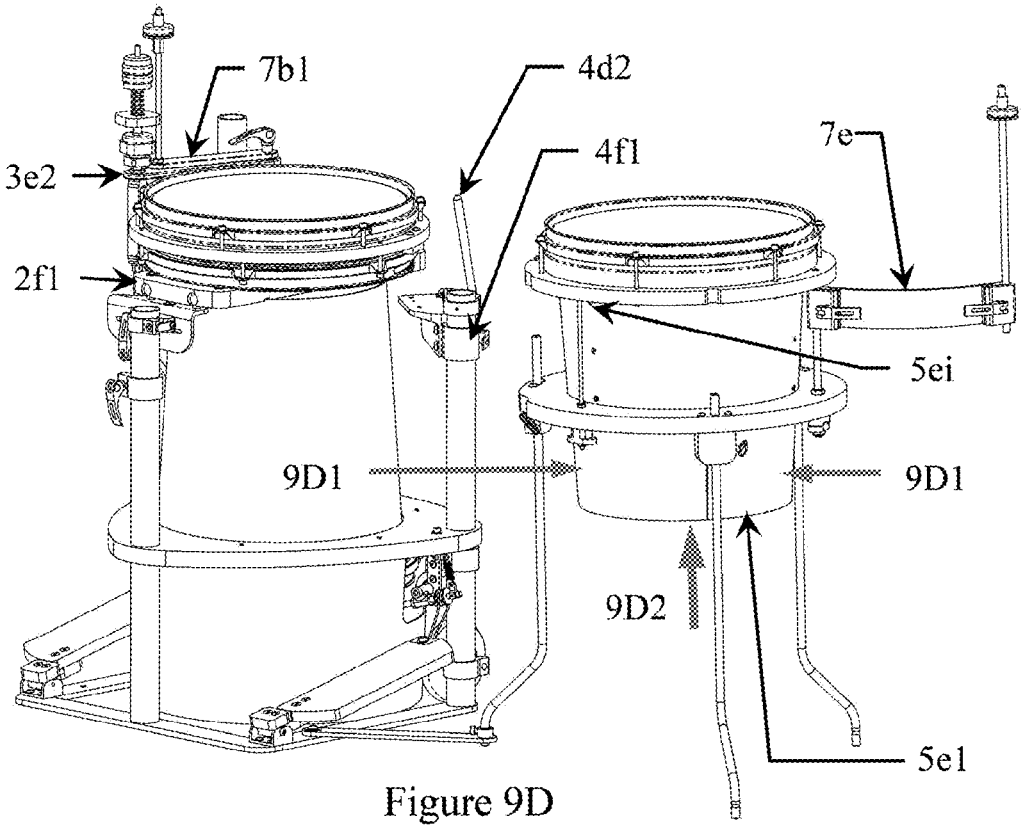
Figure 9D
Figure 9E
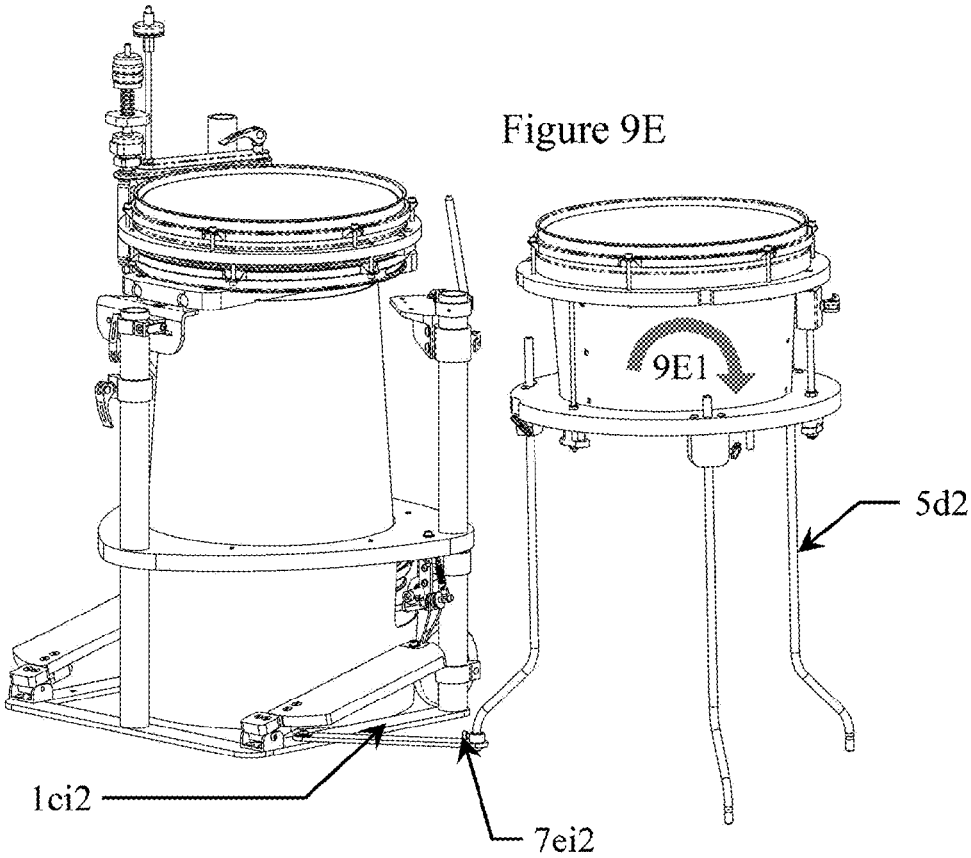

COMPACT DRUM SET AND METHODS OF USING, SETTING UP, AND COMPACTING SAME

CROSS-REFERENCE TO RELATED APPLICATION

This application claims the benefit of provisional patent application 61/091,533, filed Aug. 25, 2008 under 35 U.S.C. 119(e). This provisional patent application is incorporated by reference herein as though set forth in full.

FIELD OF THE INVENTION

The present invention relates, in general to drum sets, and, in particular, to portable compact drum sets that are quickly and easily compactable to a small, light configuration to facilitate transportation of the drum set.

BACKGROUND OF THE INVENTION

Drum sets are typically heavy and comprised of pieces that must be carried separately. Transportation of a conventional drum set usually requires a hatchback, truck or van.

More compact, portable percussion sets have been developed, usually by reducing the size and number of instruments, and usually sacrificing tonal quality. Some examples are as follows:

1. Bongos, Conga, Djembe or similar—lightweight and easy to stow and carry, but comprised of only one or two instruments.
2. Cajon—lightweight and portable, and contain instrument sub-components (snare and bass), but no toms or cymbals. Also, playing volume is limited and playing position is uncomfortable; it is played sitting on the box, bending towards the floor to strike it with bare hands.
3. Cocktail Drums—predecessor to this invention, a drum set typically played standing. While relatively compact and convenient, if suffers from the following drawbacks:
   a. The hi-hat (if one is present) is usually not articulated by a foot pedal, as the foot not used for playing the kick drum must be used for standing.
   b. Standing on one foot is tiresome.
   c. The snare drum is typically an upper chamber in the kick drum, thus compromising tone and allowing cross-talk.
   d. Adding components (toms, cymbals, etc.) adds items that must be carried separately, reducing convenience.
4. Hipgig Drums—an intermediate size, smaller than a conventional set, but larger and more full-featured than a Cocktail kit. A drum-shaped throne opens to stow hardware, and the kick drum opens to stow the snare and toms. This set offers improvements to portability, however the set is still likely to require 3 or more (kick drum, throne case, and cymbals) trips to carry, and the total weight is more than an average person can comfortably lift and/or carry.
5. Gigpig Drums—a miniaturized, full-featured kit, based on a Cajon-like box fitted with head(s) as a kick drum, an integral snare drum, and an array of cymbals and toms. The set offers portability and compactness, even rolling on integral casters, however it is not as portable or complete as the Invention (lacking an integral throne). Also the relative positions of the instruments are for practical purposes fixed; the snare and tom head surfaces are fixed in a single plane. The toms are physically shallow and lack sonic depth, resonance and projection.
6. Arbiter Flat Drums and similar—related to (likely precursor to) Gigpig drums, full-sized drum heads and shells, but having very shallow molded shells for all drums, which are rack mounted. While the drums are said to sound good, the lack of enclosed volume in the shell limits the projected volume and fullness of tone. When played in professional environments, the set is usually sound-reinforced with microphones and a public address system. Currently, many sets on the market are offered bundled with amplified speakers.
7. Electronic Drums—are compact and easily transported, however:
   a. A PA system or other amplifier/speaker system is required.
   b. Expressivity and tonal variety, as effected by nuances of playing technique, are severely limited by immature sensor, sampling and signal processing technologies.

SUMMARY OF THE INVENTION

Accordingly, the present invention is directed to a compact acoustic drum set that includes all the components of a traditional drum set, but is lightweight and easily transported. All components of the Invention, including the throne, can be stowed together in a single column, and can be carried together or rolled on integral wheels. The Invention can be transported in a single seat of a vehicle, or can be rolled aboard a common carrier, such as a bus, ferry or train.

Another aspect of the invention involves a compact transportable drum set including a bass drum; a snare drum; at least one tom drum; at least one cymbal; and a throne. The compact transportable drum set is compactable to a compact transportable single package with the bass drum, the snare drum, at least one tom drum, at least one cymbal, and the throne vertically aligned and defining an envelope volume less than 8 cubic feet and weighing less than 60 lbs.

One or more implementations of the aspect of the compact transportable drum set described immediately above include one or more of the following: the at least one cymbal includes a high hat and a crash cymbal; the at least one tom includes a floor tom and a tom tom; the throne includes a plurality of supports with two supports having fixed brackets and one support having a movable bracket, the fixed brackets and movable brackets securing the at least one tom between the plurality of supports of the throne when the compact transportable drum set is in the transportable single package; the snare drum, at least one tom drum, at least one cymbal, and the throne defining an envelope volume less than 7 cubic feet and weighing less than 50 lbs.; the bass drum, the snare drum, at least one tom drum, at least one cymbal, and the throne include vertically aligned centers; the transportable single package the at least one tom is carried within the throne; at least one tom includes a floor tom and a tom tom disposed within the floor tom; the transportable single package the snare drum is carried on top of the bass drum; the transportable single package the throne and the bass drum form a support structure for the compact transportable drum set; the transportable single package the throne includes a plurality of supports and the bass drum includes a plurality of supports that couple to the plurality of supports of the throne to form the support structure for the compact transportable drum set; at least one of the plurality of supports of the bass drum include a lower end with at least one wheel, and in the transportable single package the compact transportable drum set forms a hand truck; the throne includes a seat with an underside, and the at least one cymbal is disposed within the underside of the seat of the throne; the at least one tom drum includes an extendable sleeve member adjustable for adjusting pitch in the at least one tom drum; at least one ball joint and an elongated slot that receives the ball joint for at least 2-axis adjustment as well as adjustment of lateral position and height of the at least one tom drum and the snare drum; the bass drum includes a duct port and an interior with a curvilinear duct in communication with the duct port to form a transmission line in the bass drum; the compact transportable drum set is made of one or more of wood, plastic, composite, and metal; the at least one cymbal includes at least two cymbals with a compression spring there between and a pull line coupled to at least one of the at least two cymbals; at least one of the bass drum, the snare drum, and the at least one tom drum include one or more annular members with at least one of a wood drum shell and a composite drum shell; and/or a method of compacting and transporting the compact transportable drum set comprising providing a bass drum, a snare drum, at least one tom drum, at least one cymbal, and a throne; compacting the bass drum, the snare drum, the at least one tom drum, the at least one cymbal, and the throne into the transportable single package by providing the at least one tom drum and the at least one cymbal, providing the snare drum on the bass drum, and coupling the throne to the bass drum; and transporting the compact transportable drum set with the compact transportable drum set in the transportable single package.

It is understood that both the foregoing general description and following detailed description are exemplary and explanatory and are intended to provide further explanation to the invention as claimed. The accompanying drawings are included to provide a further understanding of the invention and are incorporated in and constitute a part of this specification, illustrate several embodiments of the invention and together with the description serve to explain the principles of the invention.

BRIEF DESCRIPTION OF THE DRAWINGS

The accompanying drawings, which are incorporated in and constitute a part of the specification, illustrate embodiments of the invention and, together with the description, serve to explain the objects, advantages, and principles of the invention. In the drawings.

FIG. 9D is a perspective view of an embodiment of a partial assembly of the compact drum set with floor tom sleeve and tertiary support extended;

FIG. 9E is a perspective view of an embodiment of a partial assembly of the compact drum set with floor tom sleeve and tertiary support retracted;

DETAILED DESCRIPTION OF PREFERRED EMBODIMENTS

Figure 1A:
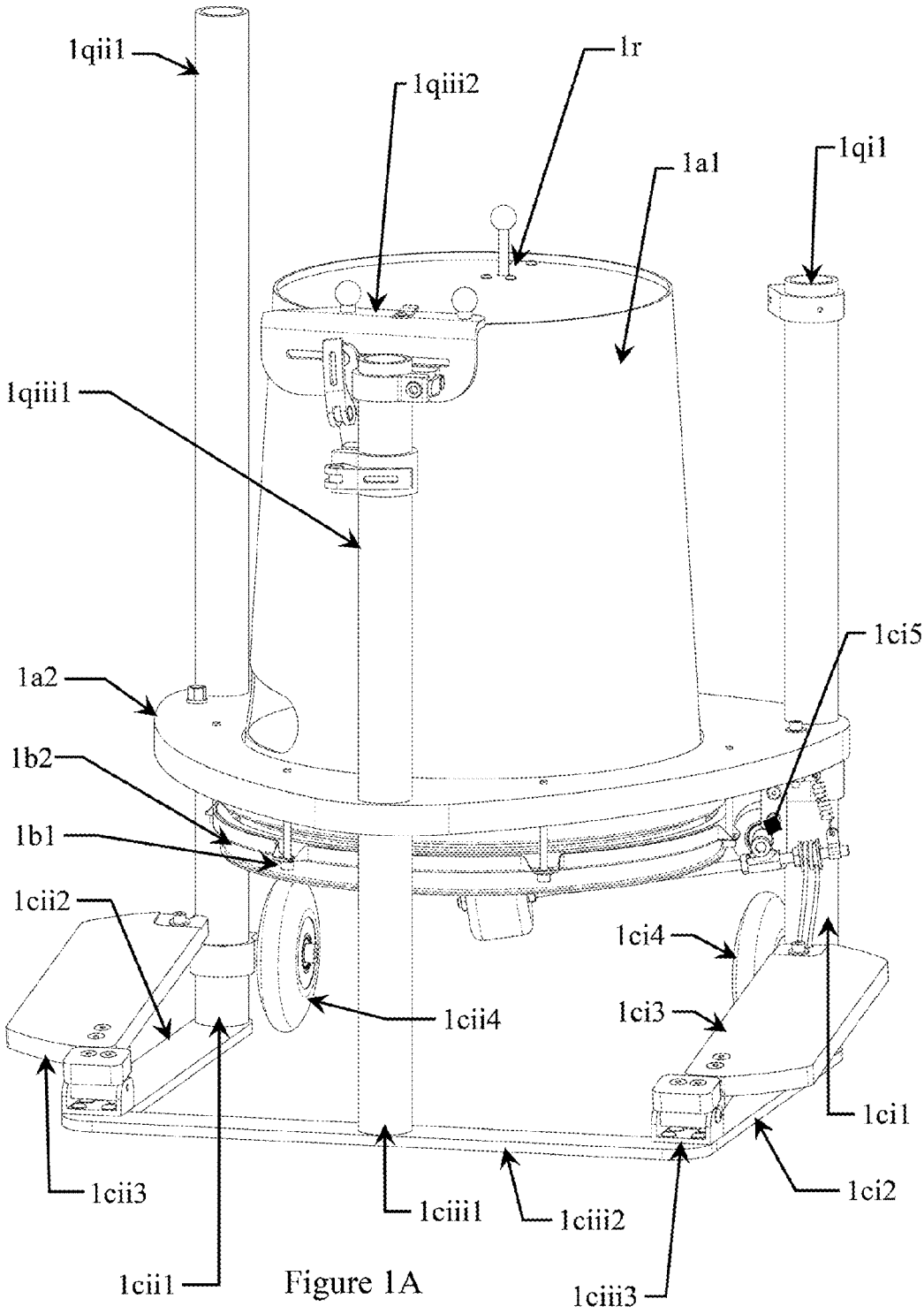
FIG. 1A is a perspective view of an embodiment of a bass drum assembly of the compact drum set, with lower baffle component not shown (for exposition purposes)
Figure 1B:
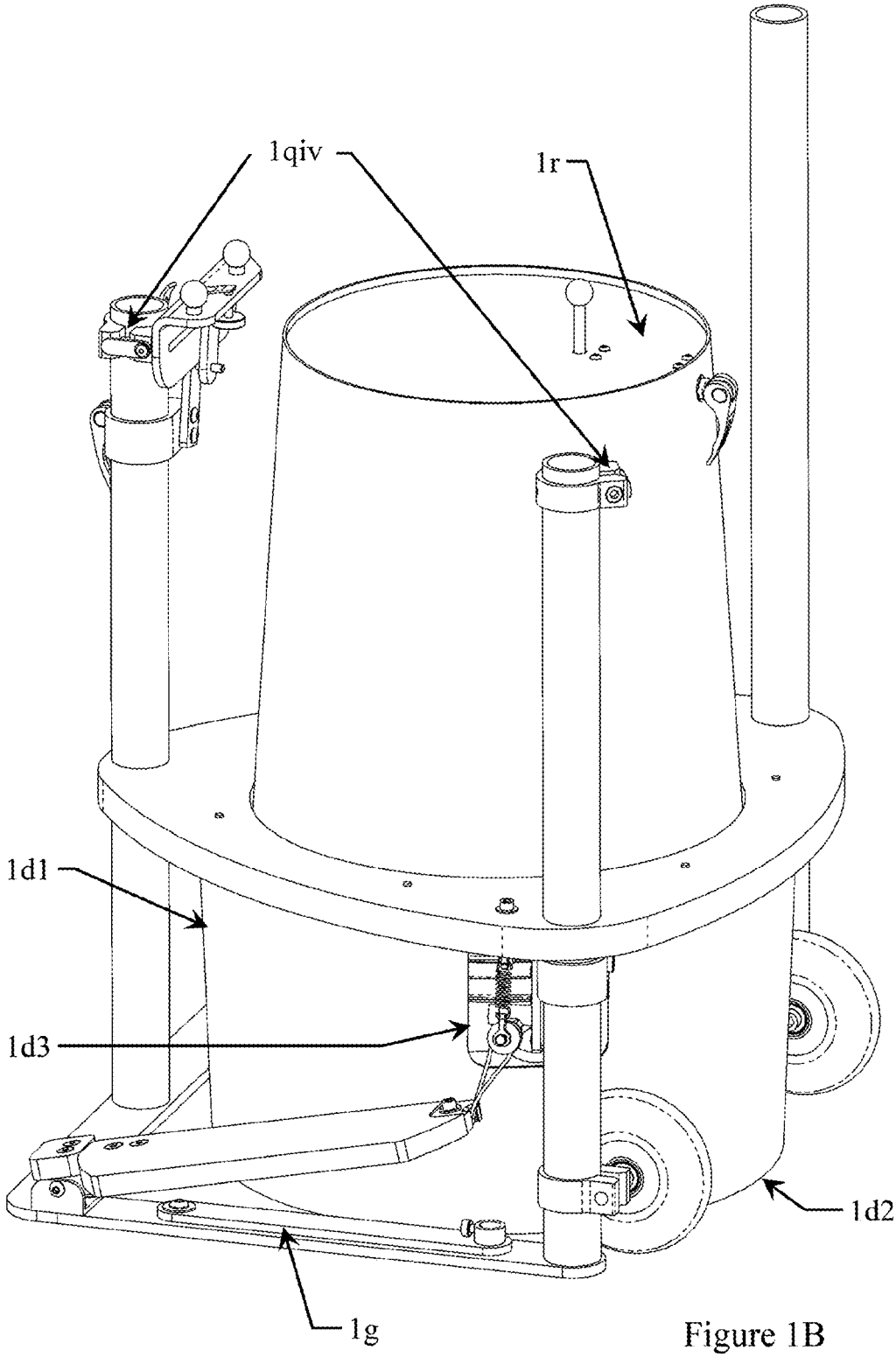
FIG. 1B is a perspective view of the embodiment of a bass drum assembly of the compact drum set, showing lower baffle component.
Figure 1C:
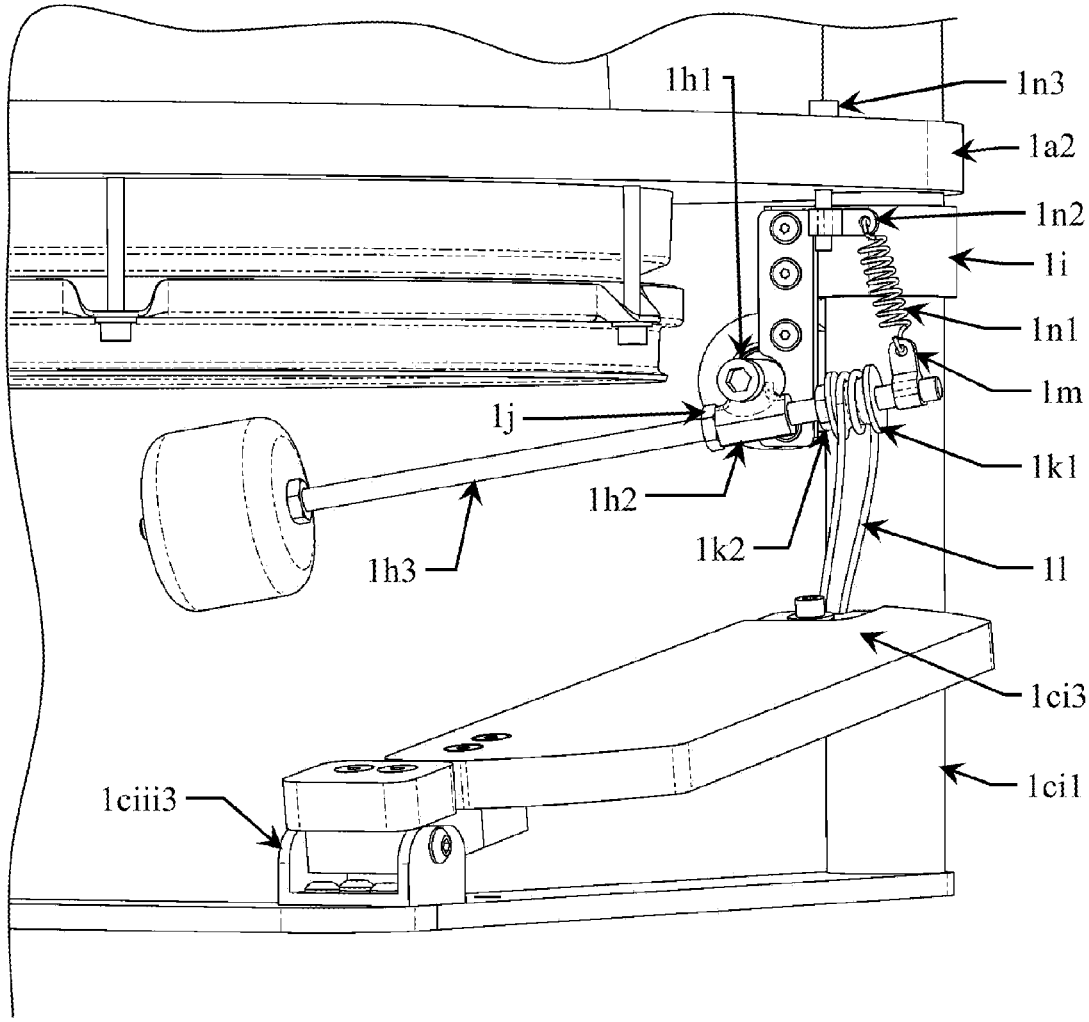
FIG. 1C is a detailed perspective view of the embodiment of a bass drum batter mechanism assembly of the compact drum set, not showing caster or lower baffle components.
Figure 1D:
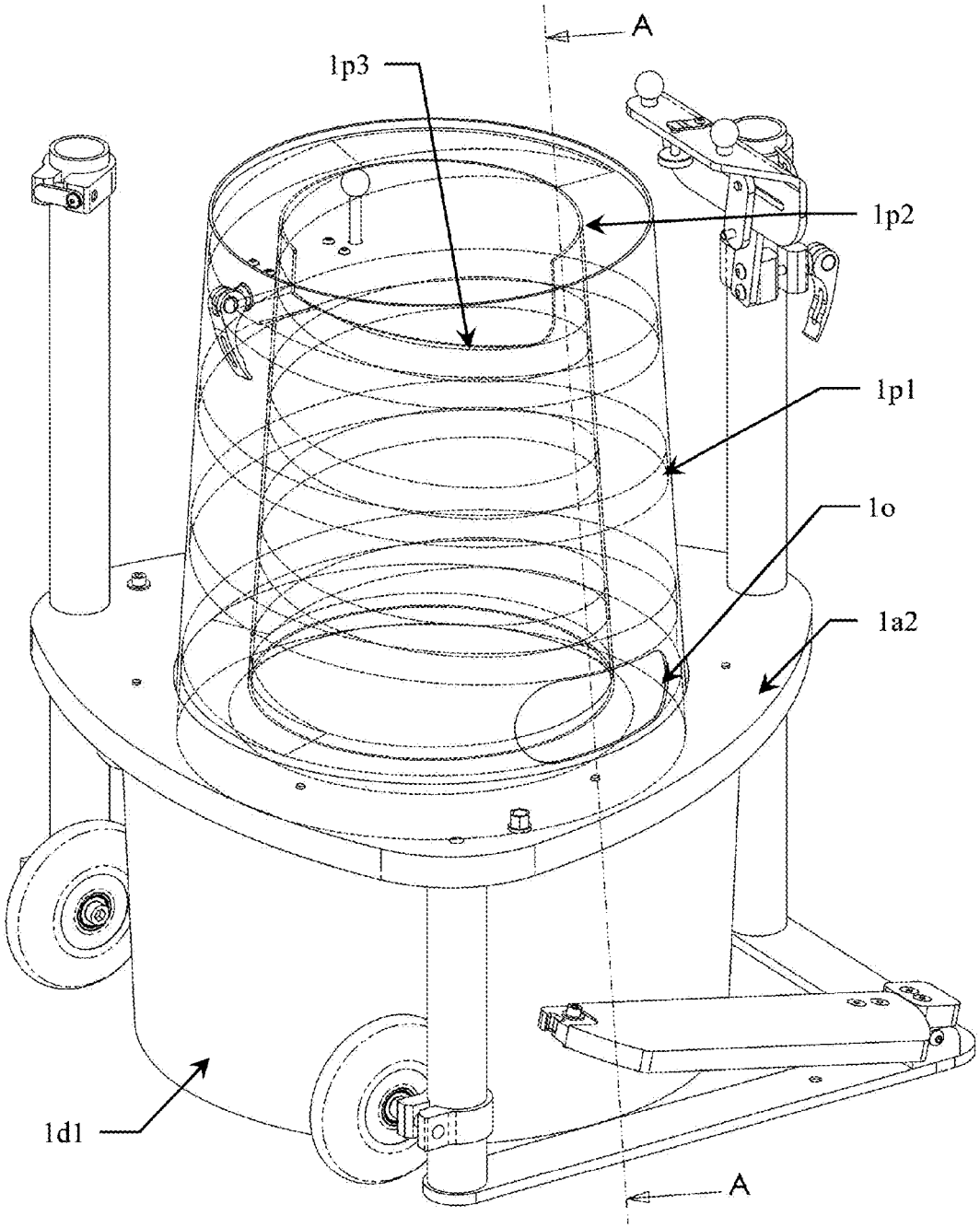
FIG. 1D is a perspective hidden-line view with section reference (to FIG. 1E) of an embodiment of a helical-ducted bass drum assembly of the compact drum set.
Figure 1E:
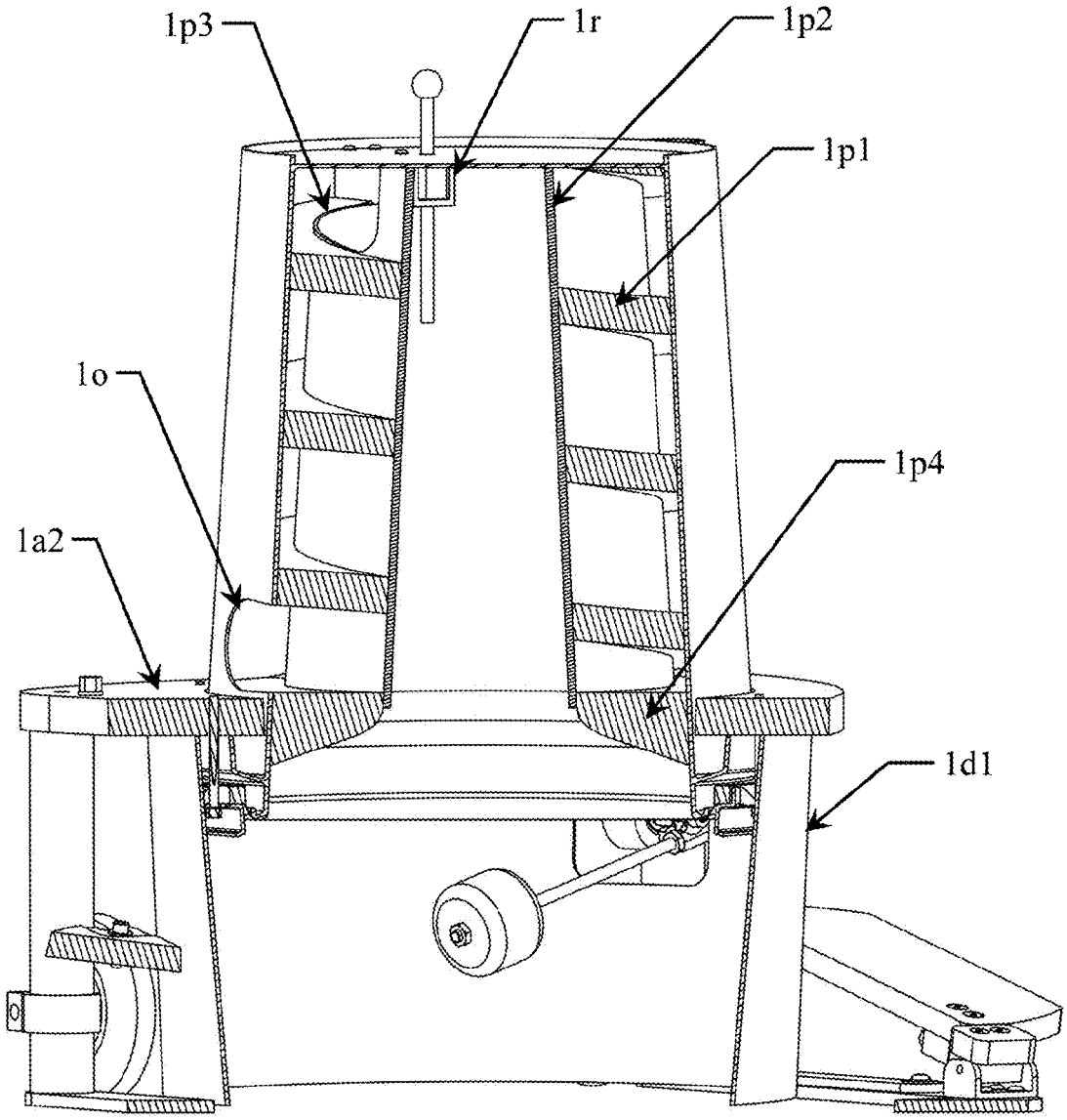
FIG. 1E is a perspective section view of the embodiment of a helical-ducted bass drum assembly of the compact drum set.
Figure 2A:
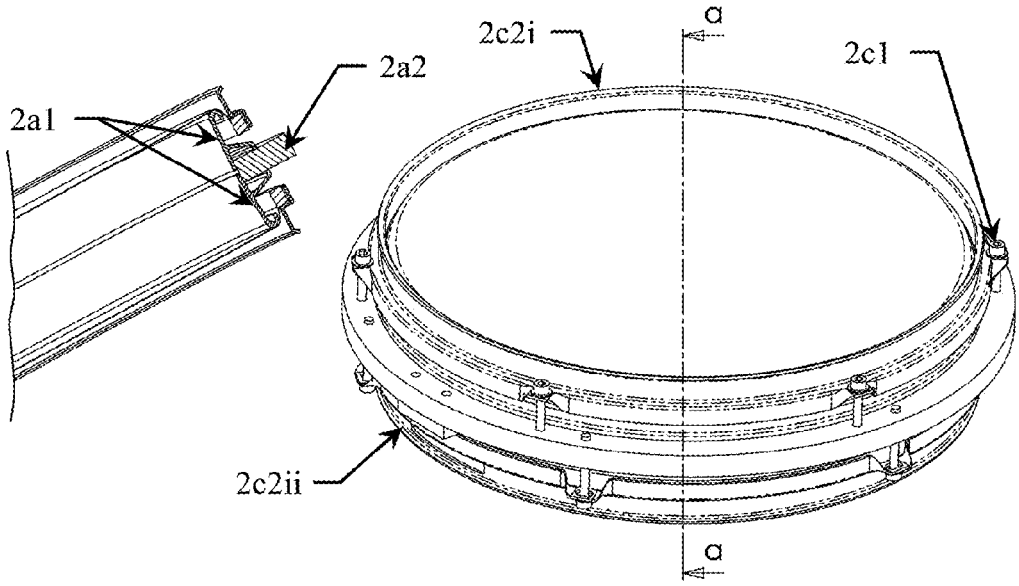
FIG. 2A is a perspective section reference and partial section view of an embodiment of a snare drum of the compact drum set.
Figure 2B:
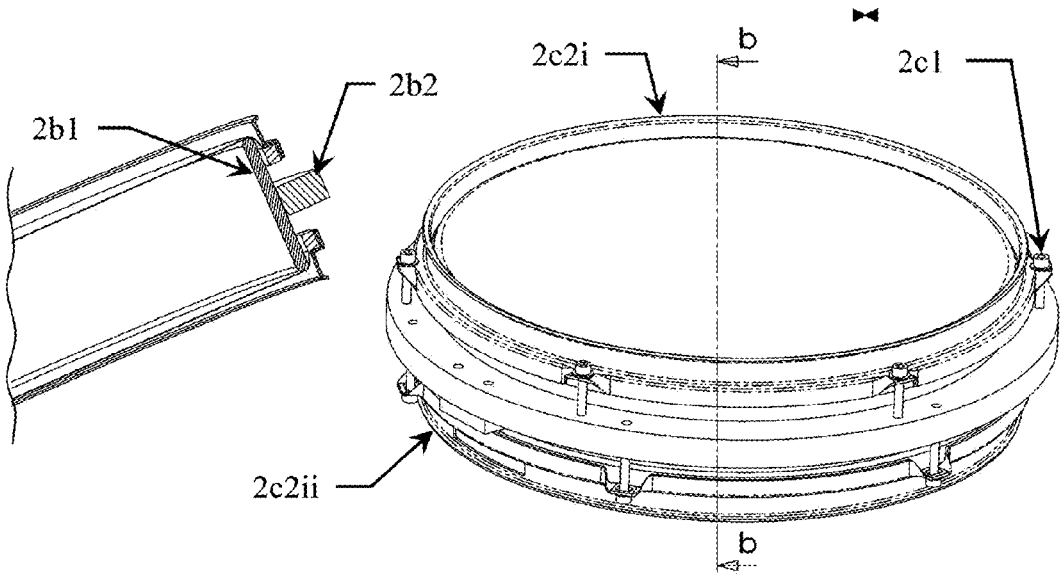
FIG. 2B is a perspective section reference and partial section view of an alternate embodiment of a snare drum of the compact drum set.
Figure 2C:
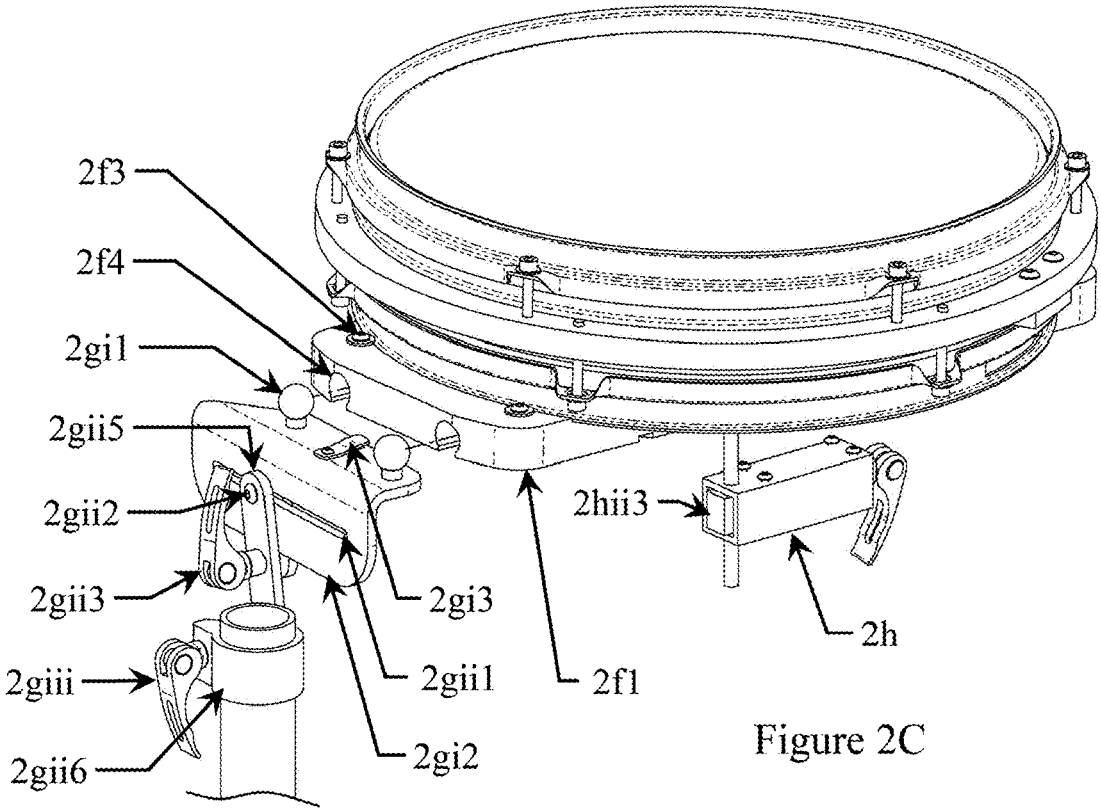
FIG. 2C is a perspective view from above of an embodiment of a snare drum and snare drum support assembly of the compact drum set.
Figure 2D:
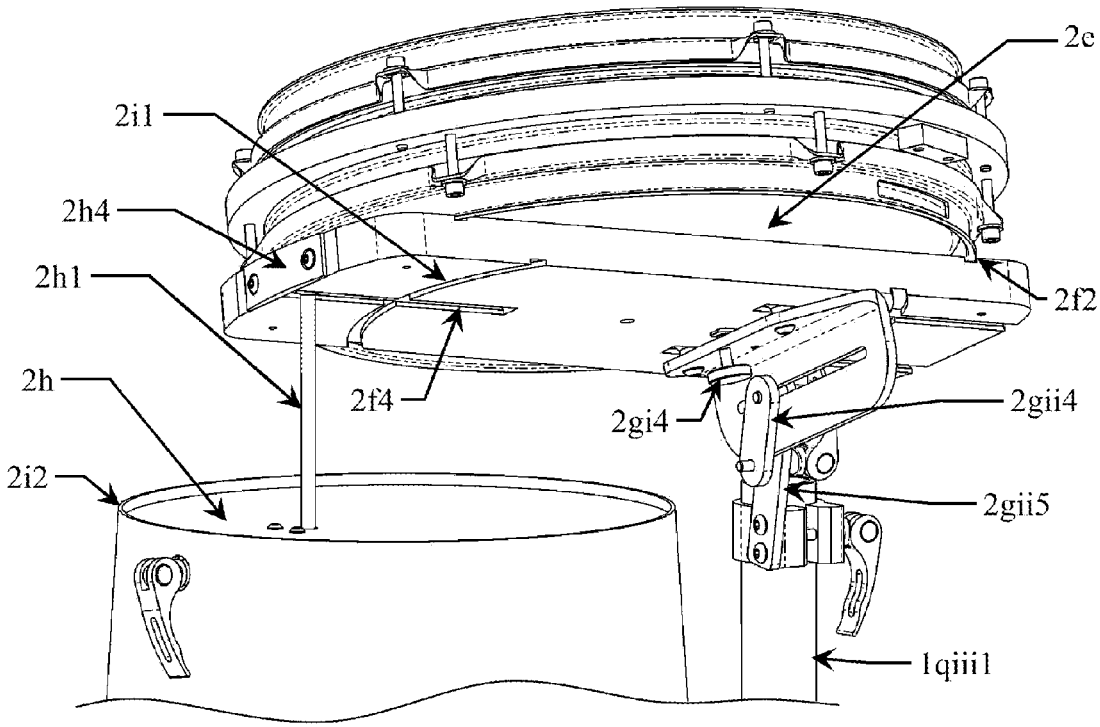
FIG. 2D is a perspective view from below of the embodiment of a snare drum and snare drum support assembly of the compact drum set.
Figure 2E:
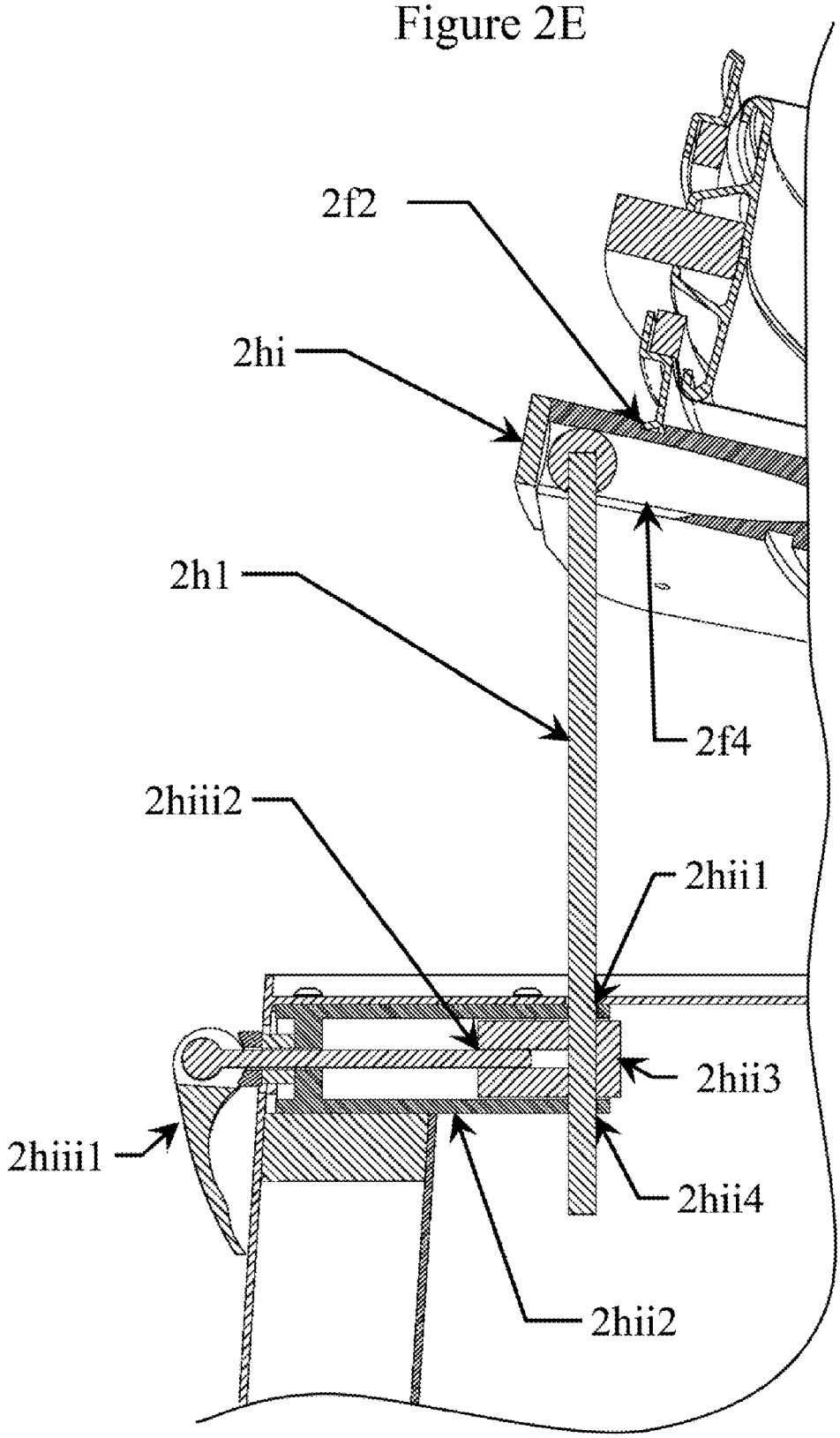
FIG. 2E is a partial section view of the embodiment of a snare drum support assembly of the compact drum set.
Figure 2F:
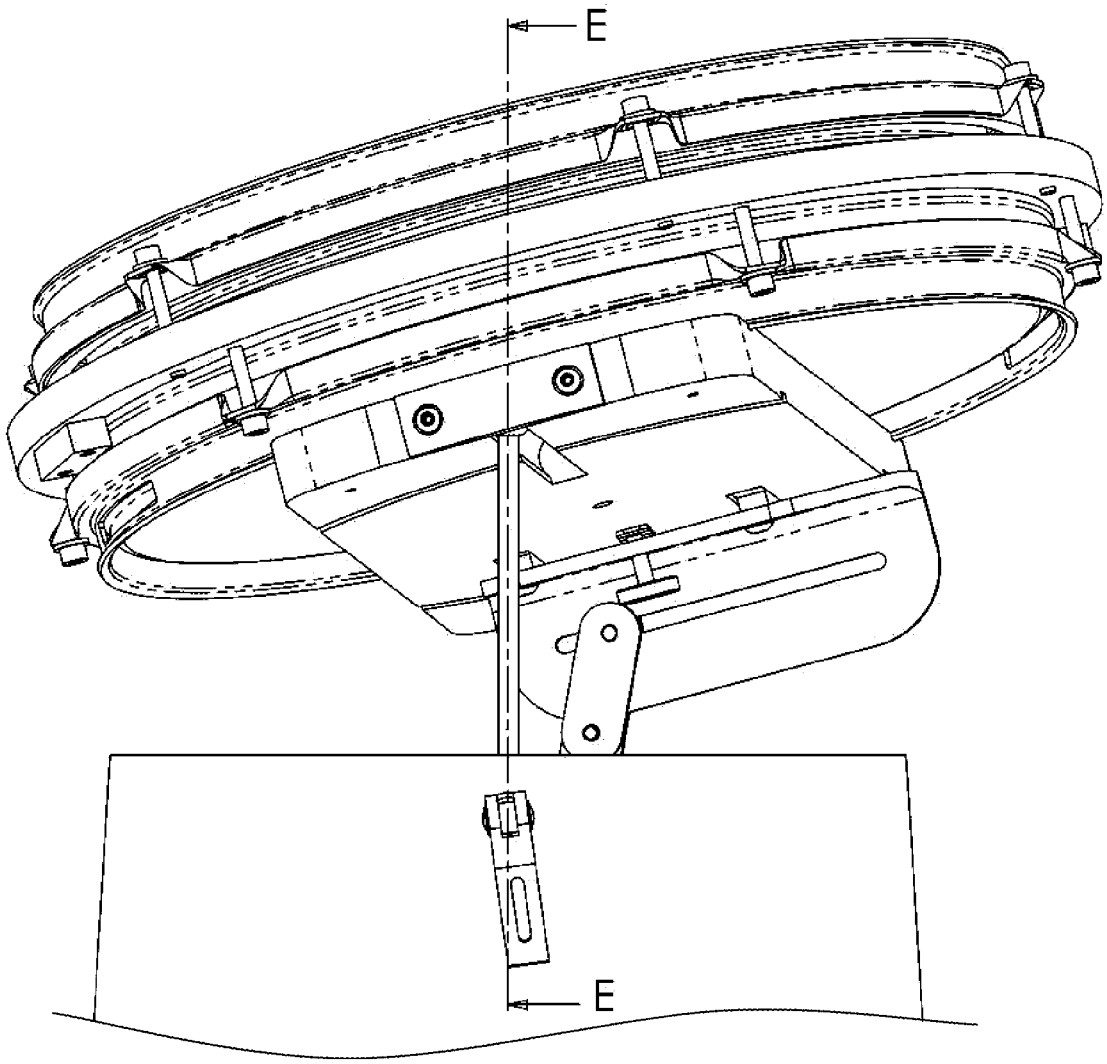
FIG. 2F is a section reference (to FIG. 2E) of the embodiment of a snare drum support assembly of the compact drum set.
Figure 3A:
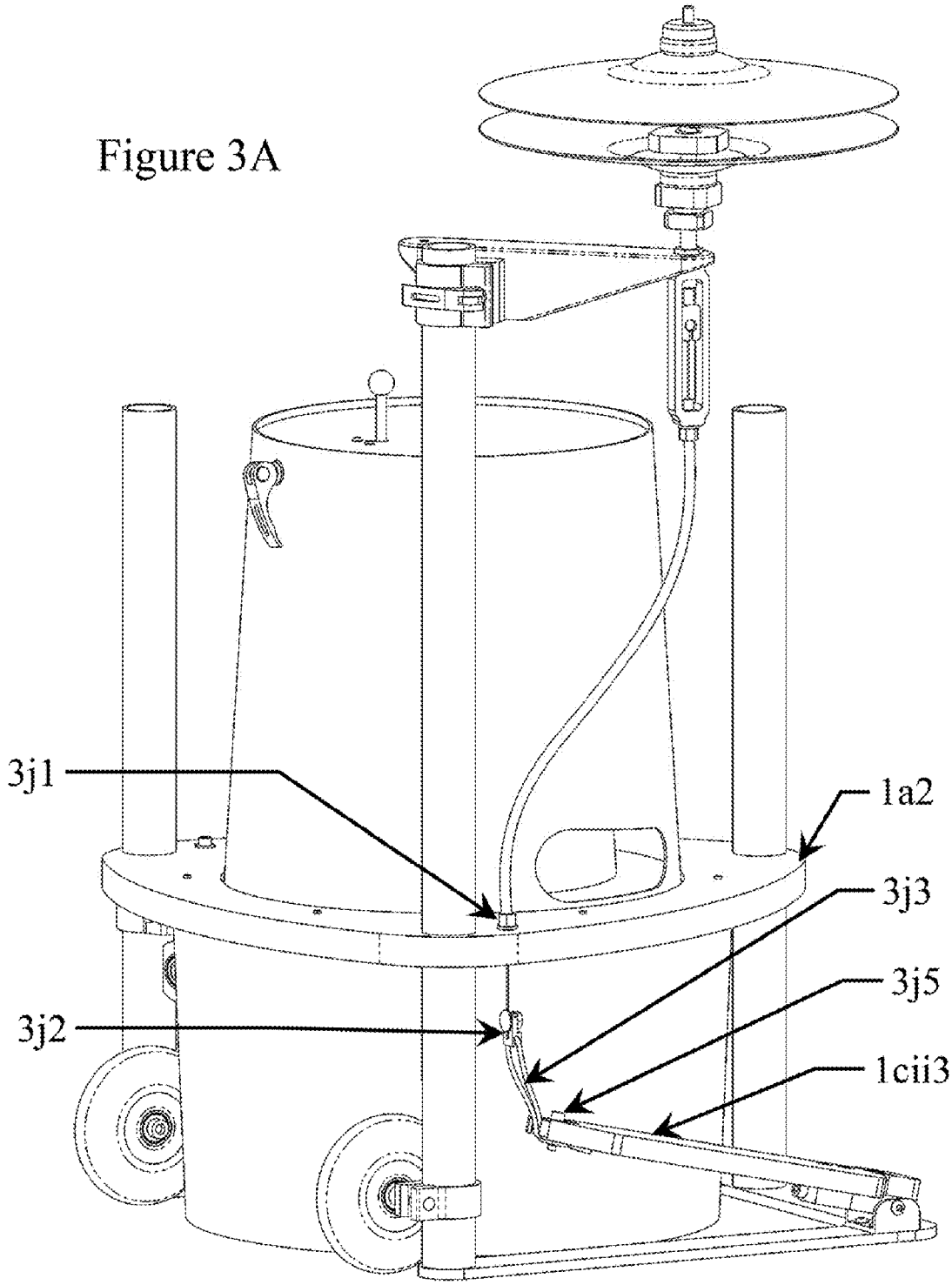
FIG. 3A is a perspective view of an embodiment of a hi-hat assembly of the compact drum set.
Figure 3B:
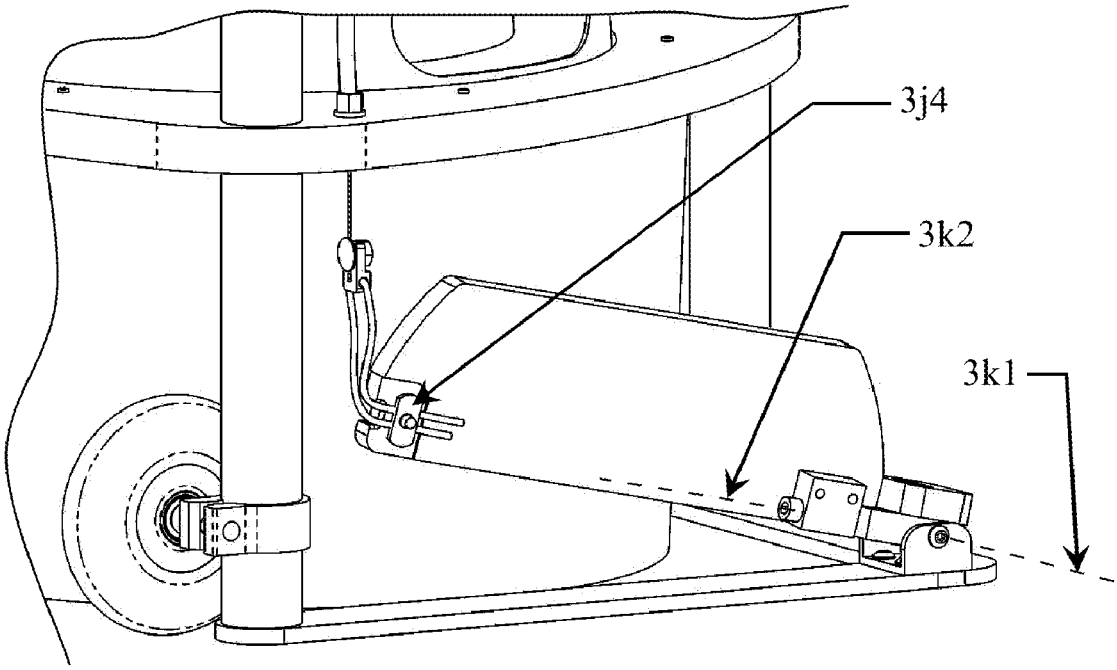
FIG. 3B is a perspective partial view of the embodiment of a hi-hat assembly showing an articulating pedal assembly of the compact drum set.
Figure 3C:
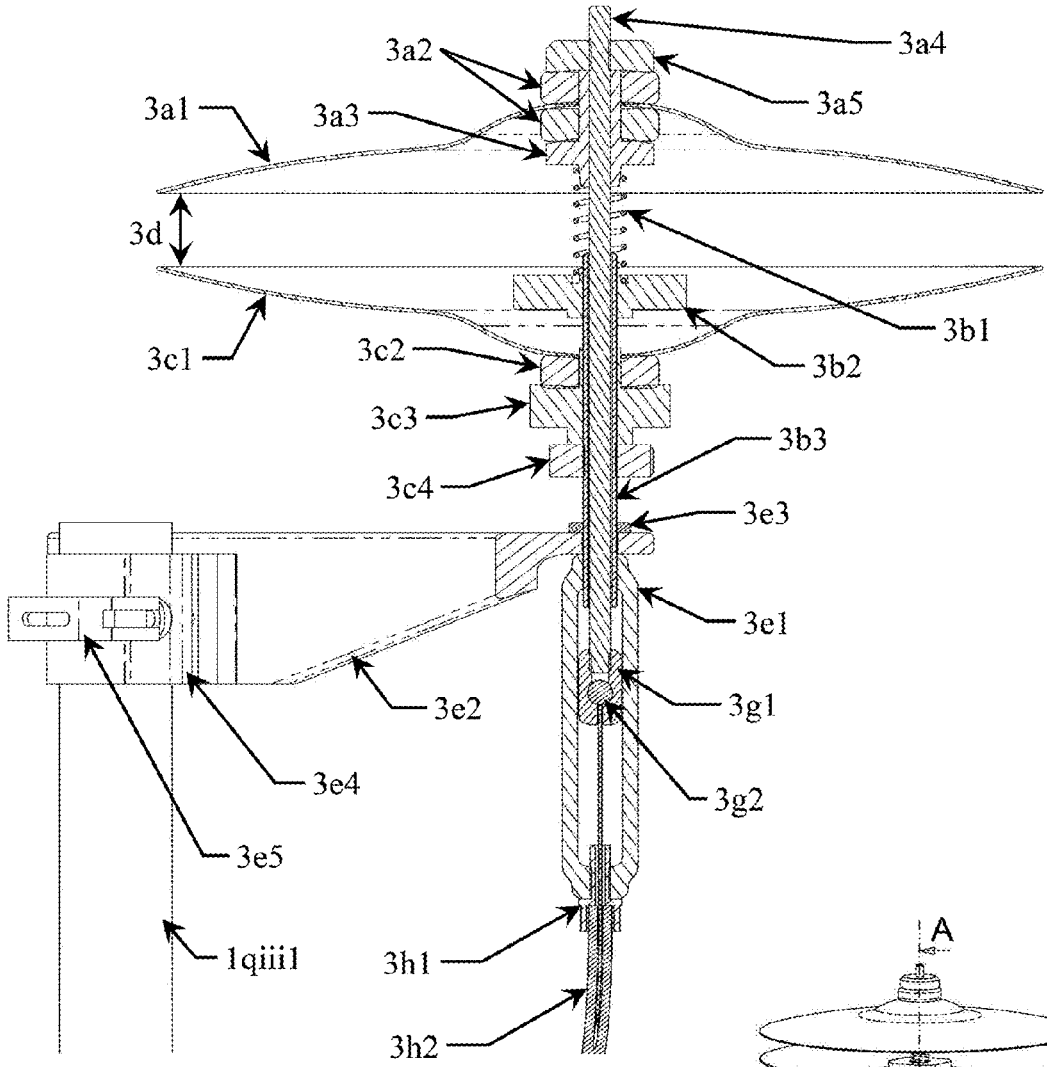
FIG. 3C is a partial section view of the embodiment of a hi-hat assembly of the compact drum set.
Figure 3D:
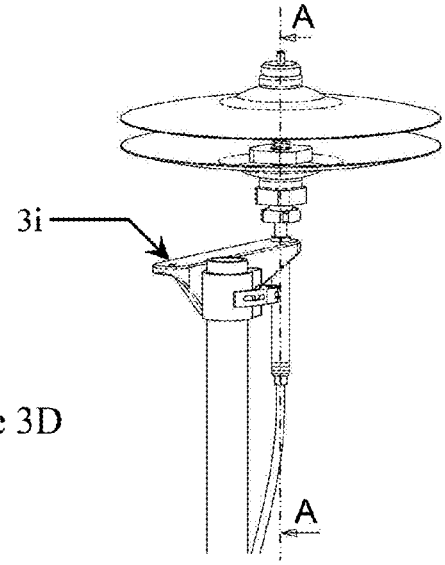
FIG. 3D is a section reference (to FIG. 3C) view of the embodiment of a hi-hat assembly of the compact drum set.

With reference to all the FIGURES, an embodiment of a compact drum set will be described. The compact drum set may be provided in a compact mode (See FIG. 10A) for easy transport of the compact drum set, and once at a desired playing location, can be easily set up (See FIG. 8A). The compact drum set includes a bass drum assembly (see FIG. 1D), a snare drum assembly (See FIG. 2D), a hi-hat assembly (See FIG. 3A), a tom tom assembly (See FIG. 4A), a floor tom assembly (See FIG. 5A), and a throne assembly (See FIG. 6A). The compact drum set may also include tertiary instruments (e.g., cymbals) as shown and described with respect to FIG. 7A.

Each component of the compact drum set will now be described.

1. With reference to FIGS. 1A-1E, an embodiment of the Bass Drum Assembly of the compact drum set will be described:

a. A wood, metal, composite or plastic shell or closed-end tube (1*a*1), with a planar member (1*a*2) oriented parallel to drum head.

b. Lug bolts (1*b*1) tension the head by means of a hoop (1*b*2) by passing through the planar member (1*a*2) along the axis of the shell (1*a*1).

c. Planar member (1*a*2) is supported by 3 legs (1*ci*1, 1*cii*1, and 1*ciii*1)

i. Right leg (1*ci*1) is braced (1*ci*2) below kick pedal (1*ci*3), and supports one caster (1*ci*4) and the batter mechanism (1*ci*5).

ii. Left leg (1*cii*1) is braced (1*cii*2) below Hi Hat pedal (1*cii*3), and supports one caster (1*cii*4).

iii. Rear leg (1*ciii*1) attached to brace (1*ciii*2) which spans the right and left braces (1*ci*2, 1*cii*2). Pedal hinges (1*ciii*3) connect the braces to each other.

d. Bass drum batter striking area is enclosed by a baffle (1*d*1) of wood, composite or plastic, with openings (1*d*2) at the floor and (1*d*3) surrounding the batter mechanism (1*ci*5).

e. Baffle (1*d*1) may be partly or completely lined with acoustic damping material, thereby increasing its effective acoustic enclosed volume.

f. The cross-sectional areas of baffle openings (1*d*1 and 1*d*2) will affect the bass drum resonant frequency and output intensity, and their designs may be adjusted to optimize resonant response.

g. Right leg brace (1*ci*2) supports an extensible brace (1*g*) which may be used to steady other instruments, such as a floor tom (see Parts 5 and 7) by linking it to the mass of the bass drum assembly.

h. Batter fulcrum (1*h*1) is comprised of a bushing fused to a coupling nut (1*h*2), through which the batter arm (1*h*3) threads.

i. Batter fulcrum (1*h*1) height is adjustable by sliding the attached clamp (1*i*) up and down the leg (1*ci*1).

j. Batter arm (1*h*3) length is adjustable by being a partially or fully threaded rod fixed with a jam nut (1*j*) to coupling nut (1*h*2).

k. Batter is actuated by pulling on batter arm (1*h*3) opposite the fulcrum (1*h*1). Mechanical advantage of pulling is adjustable by a rotating an internally threaded spool (1*k*1) about the batter arm (1*h*3) fixed with a jam nut (1*k*2).

l. Batter arm is pulled by a flexible member (1*l*) (such as a rope, cable or strap) looped and/or knotted about the spool (1*k*1) and fixed to the underside of the forward end of the kick pedal (1*ci*3).

m. Return spring mechanical advantage is adjustable by rotating an internally threaded hook member (1*m*) about the threads of the batter arm (1*h*3) end.

n. Return spring (1*n*1) tension is adjustable by a second internally threaded hook member (1*n*2) and draw bolt (1*n*3), and is tensioned by drawing against the planar member (1*a*2).

o. Bass drum (1*a*1) is fitted with a helical or serpentine duct, which, together with baffle (1*d*1), functions as a "transmission line" resonant enclosure. Duct length and cross-section may be freely adjusted in design by methods and materials used in construction of the duct. Locating the duct port (1*o*) near a flanged surface, such as planar member (1*a*2), more effectively couples the port air mass with surrounding air.

p. Duct walls (1*o*1) may be constructed by fitting a coiled strip of adhesive-backed foam (1*p*1) onto the inside wall of the bass drum before placing a close-fitting tube (1*p*2) with an inclined cut (1*p*3) into the bass drum center. A second segment of cut foam (1*p*4) seals the end of the helical duct.

q. 3 support legs (1*ci*1, 1*cii*1, 1*ciii*1) are collinear with 3 support columns (1*qi*1, 1*qii*1, 1*qiii*1), continuing above the planar member (1*a*2).

i. Right column (1*qi*1) supports one or more tom toms (see part 4)

ii. Left column (1*qii*1) supports a Hi Hat assembly (see part 3)

iii. Rear column (1*qiii*1) supports a clamp assembly (1*qiii*2) which supports the rear of the Snare (see part 2)

r. A clamp mechanism (1*r*) mounted inside the bass drum (1*a*1) clutches a post which supports the front of the Snare (see part 2).

2. With reference to FIGS. 2A-2F, an embodiment of the Snare Drum Assembly of the compact drum set will be described:

a. A pair (2*a*1) of metal, plastic or composite flanged rims supported by an annular member (2*a*2) oriented parallel to the heads, or b. A metal, wood, composite or plastic shell (2*b*1) inside the circumference of an annular member (2*b*2) oriented parallel to the heads.

c. Lug bolts (2*c*1) tension the heads by means of hoops (2*c*2*i*, 2*c*2*ii*) by passing through the annular member along the axis of the shell.

d. Snare wires and a tensioning/engagement ('throw-off') mechanisms as is typically used in a snare drum may be adapted for mounting to annular member (2*a*2).

e. Cloth such as a rag or towel, or foam or other soft material (2*e*) can be removably placed between the planar member (2*d*1) and the snare head, controlling and muting the snare wires' response.

f. A planar member (2*f*1) supports the drum from below. Annular grooves (2*f*2) cut in the planar member top to mate the lowermost edge of the snare hoop (2*c*2*ii*), and may be secured thereto using screws or other fasteners (2*f*3). Long undercut slots (2*f*4) located underside and along the front-to-rear axis of the planar member (2*f*1) allow support by and positional adjustment relative to the bass drum assembly.

g. Planar member (2*f*1) is supported at the rear by engaging a clamp mechanism (2*g*, from part 1*qiii*2) attached to the bass drum.

i. Ball posts (2*gi*1) attached to a bracket (2*gi*2) mate and engage slots (2*f*4), permitting front-to-back positional adjustment of the snare drum but restricting vertical motion by tangency to the slots undercut surfaces. A desired front-to-back position can be fixed by driving a flexure (2*gi*3) against the underside of the planar member (2*f*1) by tightening a thumb-screw (2*gi*4) beneath the bracket.

ii. Lateral adjustment of bracket (2*gi*2) position is enabled by a slot (2*gii*1), permitting left-to-right positional adjustment of the snare drum. Roll (tilt about a front-to-rear axis) orientation adjustment is enabled by rotating the bracket about a fastener (2*gii*2) passing through the slot. A desired roll orientation can be fixed by securing a cam-closure (2*gii*3) that binds the bracket between one narrow plate (2*gii*4) and another (2*gii*5), which is longer and is attached to a tube clamp (2*gii*6), which supports the clamp mechanism (2*g*) by connection to the rear column of the bass drum assembly (part 1*qiii*1).

iii. Tube clamp (2*gii*6) position can be adjusted vertically along the rear column (part 1*qiii*1), allowing height and pitch (tilt about a left-to-right axis) adjustment of the drum position and orientation. A desired position and orientation can be fixed by securing a cam-closure (2*giii*).

h. Planar member (2*d*1) is supported at the front by a ball and post (2*h*1) held in a clamp mechanism (2*h*, from part 1*r*) attached to the bass drum. Ball mates and engages slot (2*f*4), permitting front-to-back positional adjustment of the snare drum but restricting vertical motion by tangency to the slot undercut surfaces.

i. A stop plate (2*hi*) constrains ball post (2*h*1) within the slot (2*f*4); it is attached after assembly of ball post (2*h*1) into slot (2*f*4).

ii. For height adjustment, the post (2*h*1) passes freely through a vertical hole (2*hii*1) in the clamp body (2*hii*2), then freely through a vertical hole in the clamp shuttle (2*hii*3), then freely through a second vertical hole (2*hii*4) in the clamp body.

iii. Ball post (2*h*1) position can be adjusted vertically, allowing height and pitch (tilt about a left-to-right axis) adjustment of the snare drum position and orientation. A desired position and orientation can be fixed by securing a cam-closure (2*hiii*1) the threaded end of which engages a horizontal threaded hole (2*hiii*2) in the clamp shuttle (2*hii*3). Engaging the cam lever draws the shuttle vertical hole to imperfect alignment with clamp body vertical holes (2*hii*1 and 2*hii*4), thereby binding and securing the post at its present height.

i. Annular grooves (2*i*1) in the underside of the planar member (2*d*1) constrain the snare drum assembly position in the stowed configuration (see part 10) by mating and engaging with congruent feature(s) (2*i*2) on the top of the bass or drum (part 1*a*1) when aforementioned clamps (2*g* and 2*h*2) are collapsed and secured with the snare drum central axis aligned with that of the bass drum.

3. With reference to FIGS. 3A-3D, an embodiment of the Hi Hat Assembly of the compact drum set will be described:

a. An upper cymbal (3*a*1) is held between 2 felt washers (3*a*2) about a carrier bushing (3*a*3), through which freely passes a pull-rod (3*a*4) which is threaded at each end. The upper end of the pull rod threads into an internally threaded cap bushing (3*a*5). The threaded end of the pull-rod (3*a*4) protruding from the cap bushing may support the mounting of tertiary percussion instruments, such as a bell or a small tambourine.

b. Carrier bushing (3*a*3) is supported by a co-axial compression spring (3*b*1) supported in turn by an internally threaded nest bushing (3*b*2) supported in turn by an externally threaded pipe (3*b*3).

c. A lower cymbal (3*c*1) rests on a felt washer (3*c*2) supported by an internally threaded cradle bushing (3*c*3), supported in turn by the externally threaded pipe (3*b*3). An oversize nut (3*c*4) acts as a lock-nut to secure a desired position of the cradle bushing.

d. The relative vertical distance between nest bushing (3*b*2) and cradle bushing (c3) determine hi-hat assembly opening distance (3*d*) and restoring spring force.

e. The lower end of threaded pipe (3*b*3) mates internal threads of a pull-frame member (3*e*1) and secures the cymbal assembly to a beam member (3*e*2) with a small nut (3*e*3). The beam member is attached to a clamp (3*e*4) supported by (bass drum assembly support) column (part 1*qiii*1). A desired position and orientation of the assembly may be fixed by securing a cam closure (3*e*5). Pull-frame member (3*e*2) may be adapted from an extruded profile commonly used as a turnbuckle frame.

f. A thin-walled plastic tube, such as commonly used as a drinking straw, guides and lubricates the sliding passage of the pull rod (3*a*4) through the externally threaded pipe (3*b*3).

g. The lower threaded end of the pull-rod (3*a*4) mates internal threads in a shuttle member (3*g*1) which has a bore and a slot feature to capture a cable end slug (3*g*2) integral to a cable, such as commonly used as a bicycle brake or shifter cable.

h. Internal threads in the lower end of pull-frame member (3*e*2) mate external threads of a vented bolt (3*h*1) such as commonly used as a bicycle brake cable adjusting barrel. A bore in the non-threaded end of the vented bolt holds a cable sheath (3*h*2), through which passes a cable, the upper terminus being cable end slug (3*g*2), which is used to actuate the hi-hat mechanism.

i. Hole(s) (3*i*) in the beam member (3*e*2) may accommodate the mounting of tertiary percussion, such as support for a crash cymbal (see part 7).

j. The lower end of cable sheath (3*h*2) is held in a second vented bolt (3*j*1) which threads into a hole in bass drum planar member (part 1*a*2). The free end of the pull-cable (opposite 3*g*2) passes freely through the planar member (1*a*2) and is fastened to knuckle member (3*j*2) using common bicycle brake cable hardware. A flexible member (3*j*3) such as a string or strap passes through a hole in the knuckle member and both free ends are fastened beneath a flanged nut (3*j*4) or similar, beneath the end of the hi-hat pedal (part 1*cii*3). The playing angle of the pedal may be adjusted by pulling the flexible member to a desired length, then tightening a bolt (3*j*5) on the top side of the pedal.

k. The pedals (1*cii*3, and also bass drum pedal 1*ci*3) are each hinged along 2 distinct and perpendicular axes. One axis (3*k*1) allows pedal articulation through a small angle, for playing. A second axis (3*k*2) allows the pedal to pivot from a substantially horizontal orientation into a substantially vertical orientation. The second axis and orientation option allow a broad surface to be available for foot contact which can alternately stow in a compact vertical position.

Figure 4A:
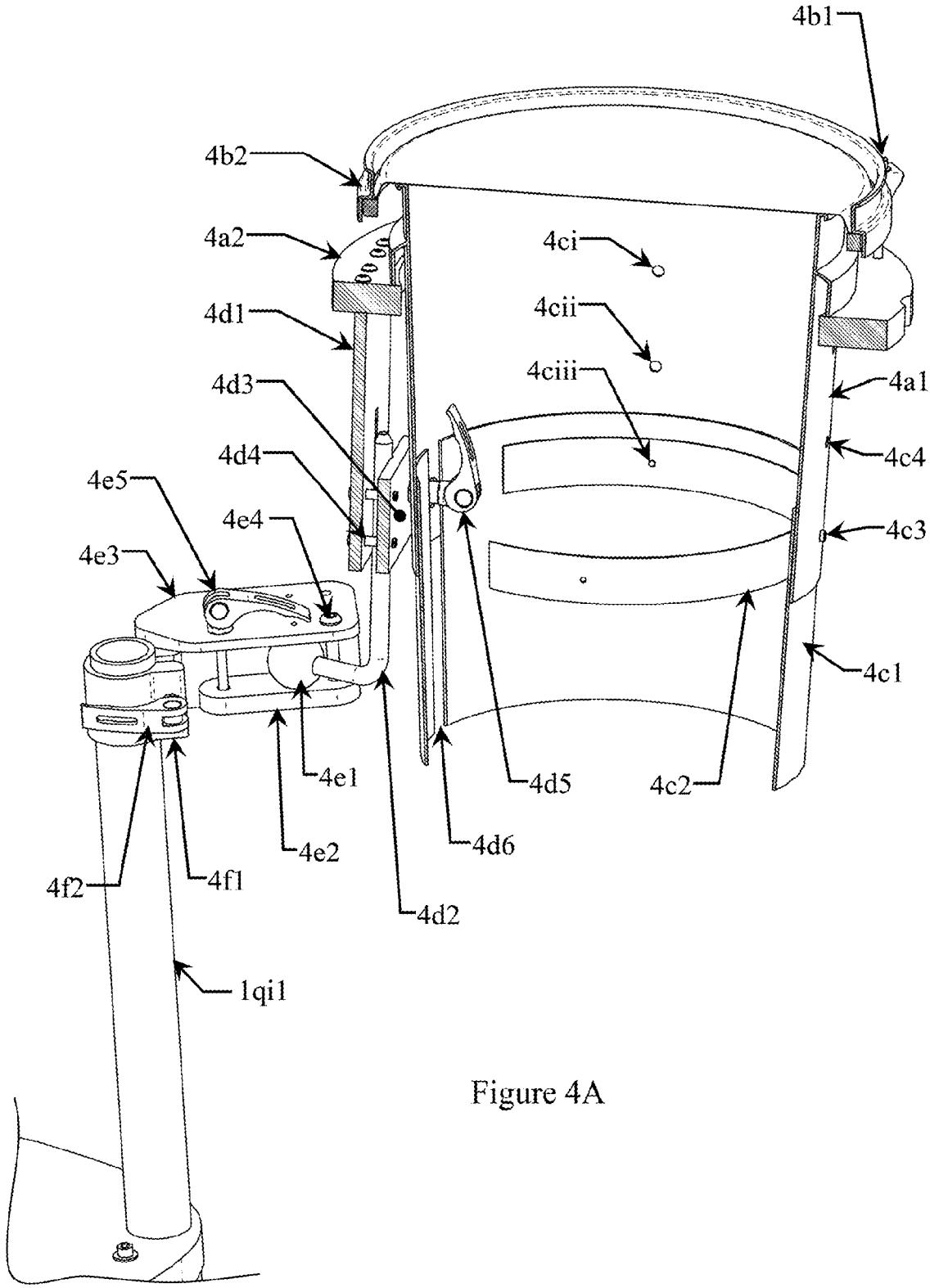
FIG. 4A is a perspective partial section view of an embodiment of a tom tom and tom tom support assembly of the compact drum set.

4. With reference to FIG. 4A, an embodiment of the Tom Tom Assembly of the compact drum set will be described:

a. A wood, metal, composite or plastic shell (4*a*1), with an annular member (4*a*2) oriented parallel to drum head.

b. Lug bolts (4*b*1) tension the head by means of a hoop (4*b*2) by passing through the annular member (4*a*2) along the axis of the shell.

c. A telescoping sleeve member (4*c*1) is placed at one of several positions, extending from the bottom of the drum. A flexure member (4*c*2) is fastened near the top of the sleeve at one or more points, and is pre-disposed to expand and push the sleeve outer diameter against the drum inside diameter. The fastener heads (4*c*3) selectively occupy (mate into) holes (4*c*4) along the length of the drum. Horizontally aligned sets of holes accommodate discrete positions of the sleeve, each offering desired characteristics.

i. Top row occupied: sleeve is in fully stowed position, and drum is at minimum overall length. This position is optimal for high-pitched tuning of the drum.

ii. Middle row occupied: sleeve is partially extended; drum can be tuned lower and still have a pleasing resonance.

iii. Bottom row occupied (as shown in FIG. 4A): sleeve is fully extended; drum can be tuned still lower, possessing adequate enclosed length and volume to support a pleasing resonance.

d. Annular member (4*a*2) is attached to and supported by a plate member (4*d*1). A supporting spike member (4*d*2) is held between the plate and a clamp member (4*d*3), and between tensioning members consisting of one or more bolts (4*d*4) and a cam closure (4*d*5). Cylindrical mating surfaces on the plate and clamp mate the substantially cylindrical surface of the spike end. A desired rotational position of the drum about the spike can be fixed by securing the cam closure (4*d*5). If packaging constraints require location of the cam closure inside the drum, a slot (4*d*6) in sleeve member (4*c*1) may provide clearance needed for articulation.

e. A ball element (4*e*1) integral with and at the lower end of spike member (4*d*2) is held between clamp (4*e*2) and beam (4*e*3) members and between tensioning members consisting of a bolt (4*e*4) and a cam closure (4*e*5). Spherical mating surfaces on the clamp (4*e*2) and beam (4*e*3) ensure areas of contact. A desired orientation of the spike (and associated drum) can be fixed by securing the cam closure (4*e*5). As the beam (4*e*3) may be fashioned from a "T" shaped extrusion section, provision for clamping an additional ball (associated with an additional Tom Tom drum, or tertiary percussion instrument) exists on the opposite side of the beam (4*e*3).

f. Beam (4*e*3) is fixed to a clamp (4*f*1) which attaches to the right support column (part 1*qi*1). A desired vertical and rotational position of the drum may be fixed by securing a cam closure (4*f*2).

Figure 5A:
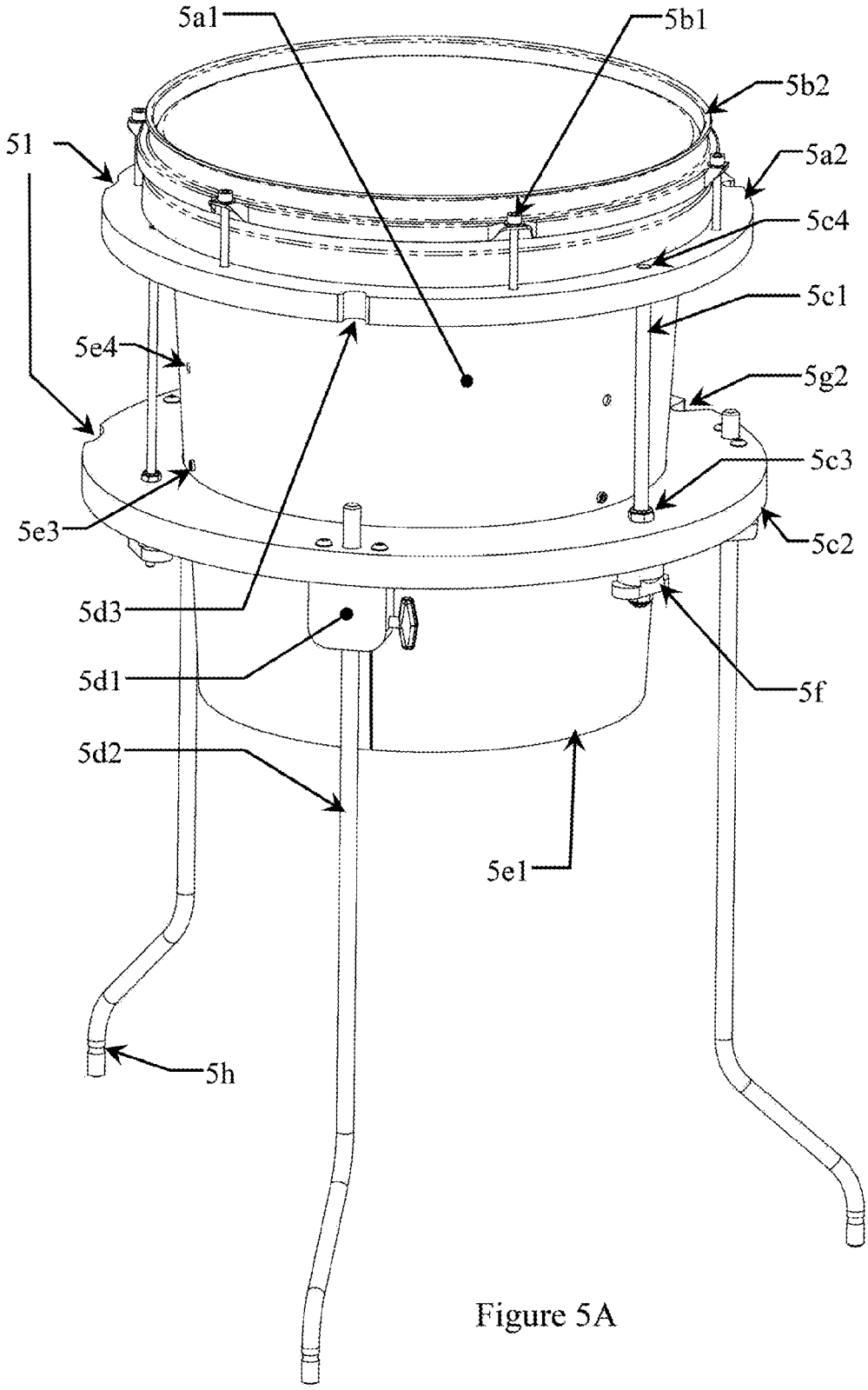
FIG. 5A is a perspective view of an embodiment of a floor tom assembly of the compact drum set.
Figure 5B:
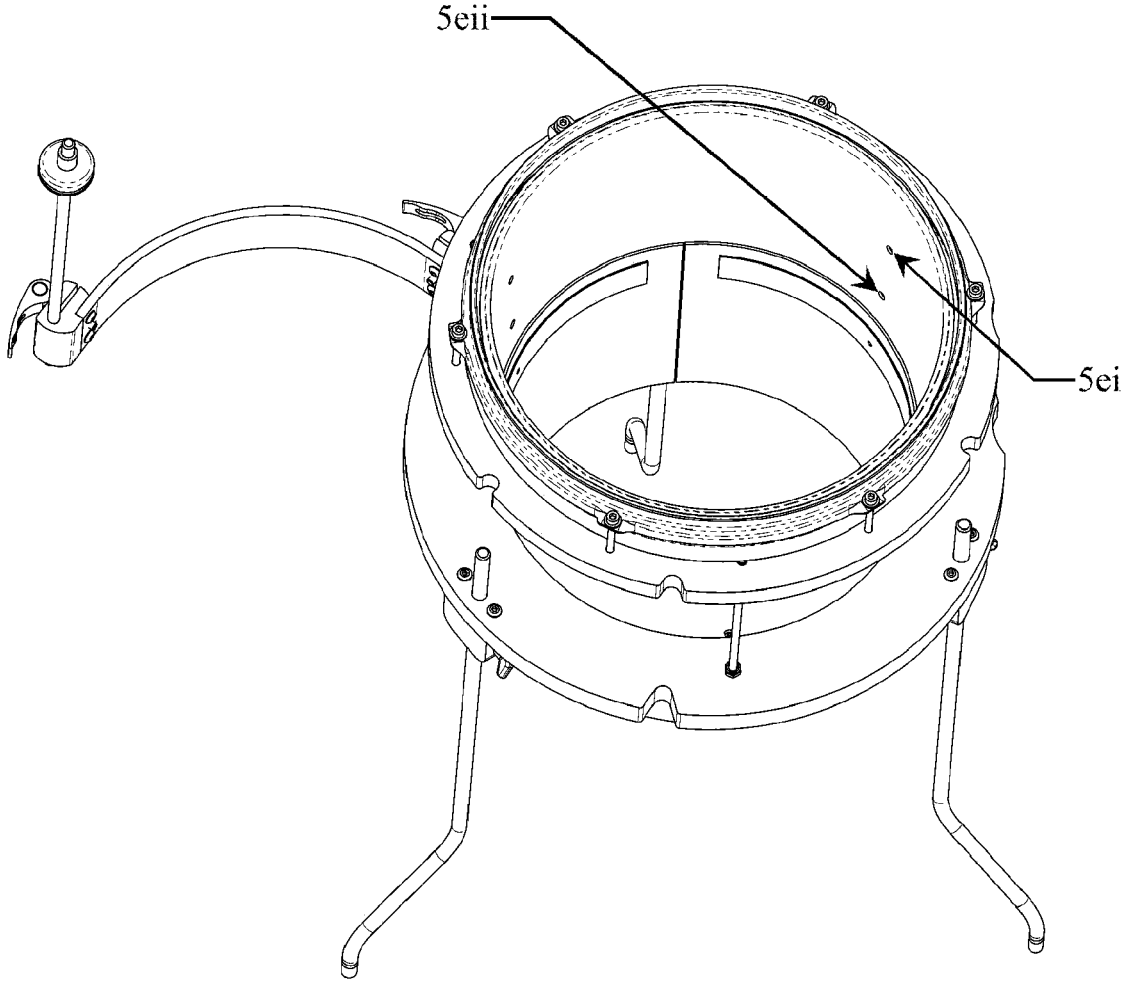
FIG. 5B is a top perspective view of the embodiment of a floor tom assembly with tertiary support beam assembly of the compact drum set.
Figure 5C:
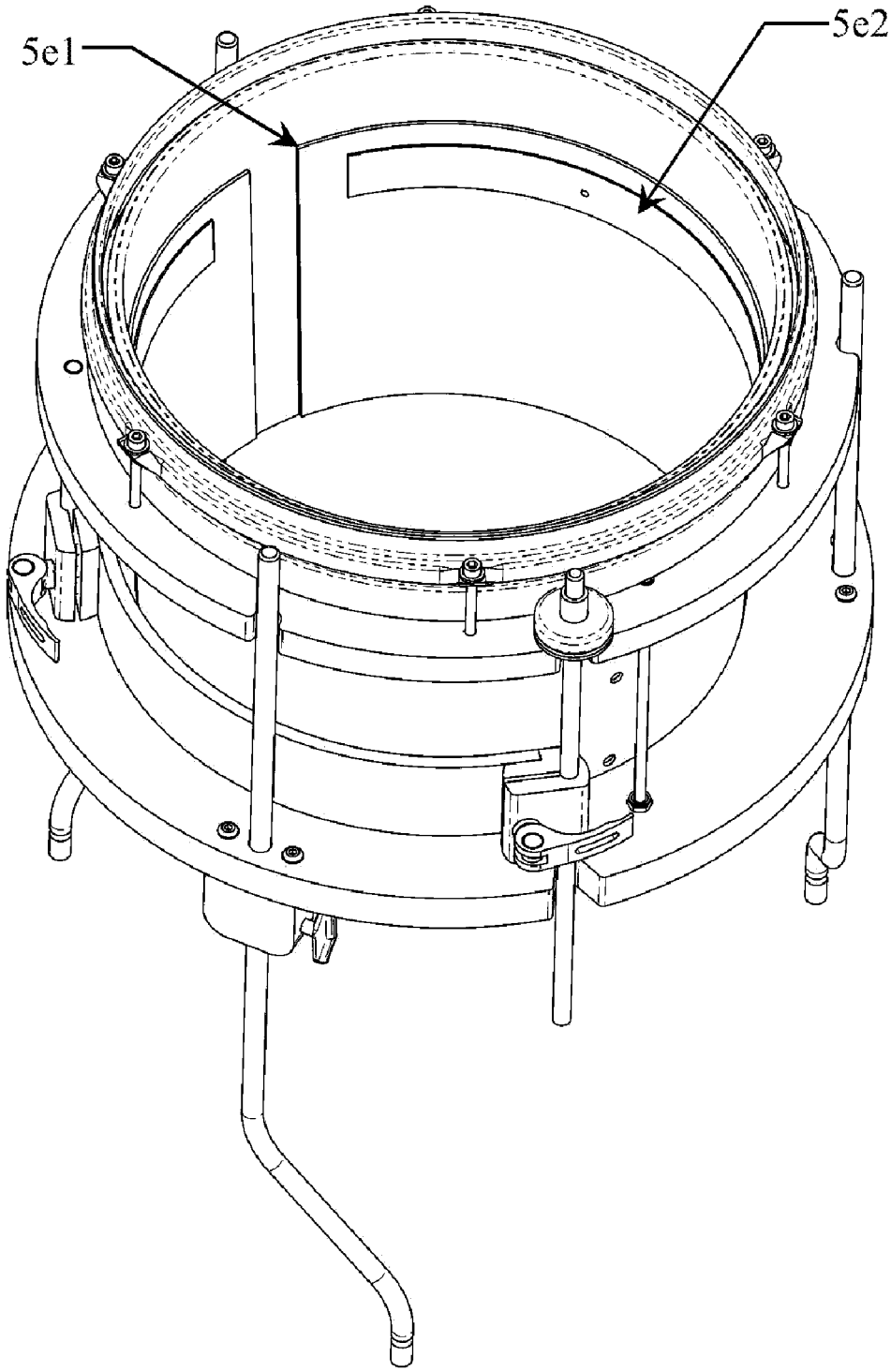
FIG. 5C is a top perspective view of the embodiment of a floor tom assembly with tertiary support beam assembly of the compact drum set, in a compact mode.

5. With reference to FIGS. 5A-5C, an embodiment of the Floor Tom Assembly of the compact drum set will be described:

a. A wood, metal, composite or plastic shell (5*a*1), with a first annular member (5*a*2) oriented parallel to drum head.

b. Lug bolts (5*b*1) tension the head by means of a hoop (5*b*2) by passing through the first annular member (5*a*2) along the axis of the shell.

c. First annular member (5*a*2) is connected by a plurality (typically 3) of partially or fully threaded rods (5*c*1) to a second annular member (5*c*2). Rods (5*c*1) hold annular members (5*a*2, 5*c*2) at a fixed distance and parallel, and are fastened by jam nuts (5*c*3) into threaded holes (5*c*4) in both annular members (5*a*2, 5*c*2). Rods (5*c*1) may also be covered with long bushings, held in compression and fixing the distance between annular members (5*a*2, 5*c*2). Rod(s) (5*c*1) may also support mounting of tertiary percussion instruments (see part 7).

d. A plurality of (typically, 3) clamps (5*d*1) are attached to the second annular member (5*c*2). A support leg (5*d*2) passes through and is fixed by each clamp (5*d*1). Slots, notches or holes (5*d*3) in the first annular member (5*a*2) allow legs (5*d*2) passage, to minimize the collapsed height of the drum.

e. A telescoping sleeve member (5*e*1) is placed at one of several positions, extending from the bottom of the drum. A flexure member (5*e*2) is fastened near the top of the sleeve at one or more points, and is pre-disposed to expand and push the sleeve outer diameter against the drum inside diameter. The fastener heads (5*e*3) selectively occupy (mate into) holes (5*e*4) along the length of the drum. Horizontally aligned sets of holes accommodate discrete positions of the sleeve, each offering desired characteristics:

i. Top row occupied: sleeve is in fully stowed position (as shown in FIG. 5C), and drum is at minimum overall length. This position is optimal for high-pitched tuning of the drum.

ii. Middle row occupied: sleeve is partially extended; drum can be tuned lower and still have a pleasing resonance.

iii. Bottom row occupied (as shown in FIGS. 5A and 5B): sleeve is fully extended; drum can be tuned still lower, possessing adequate enclosed length and volume to support a pleasing resonance.

f. A plurality of (typically, 3) clips (5*f*) fasten to the ends of each rod (5*c*1). The clips (5*f*) rotate about the rod ends, and can hold the annular member of Tom Tom (part 4.*a*2) against the second annular member (5*c*2) of the floor tom, as arranged in the stowed configuration (see FIGS. 9F, 9G and 10A).

g. Broad cylindrical notches (5*g*1) in one or both annular members (5*a*2, 5*c*2) mate with features of the Throne assembly in the stowed configuration (see FIG. 9K). Narrow notches (5*g*2) in one or both annular members (5*a*2, 5*c*2) allow for compact storage of tertiary percussion support, as may be attached to rod (5*c*1) (see part 7 and FIGS. 5B and 5C).

h. Circumferential notches (5*h*) at or near the end of each leg (5*d*2) may mate and engage the end of a thumb-screw in an extendable brace (Part 1*g*) of the bass drum assembly (see Parts 1 and 7).

Figure 6A:
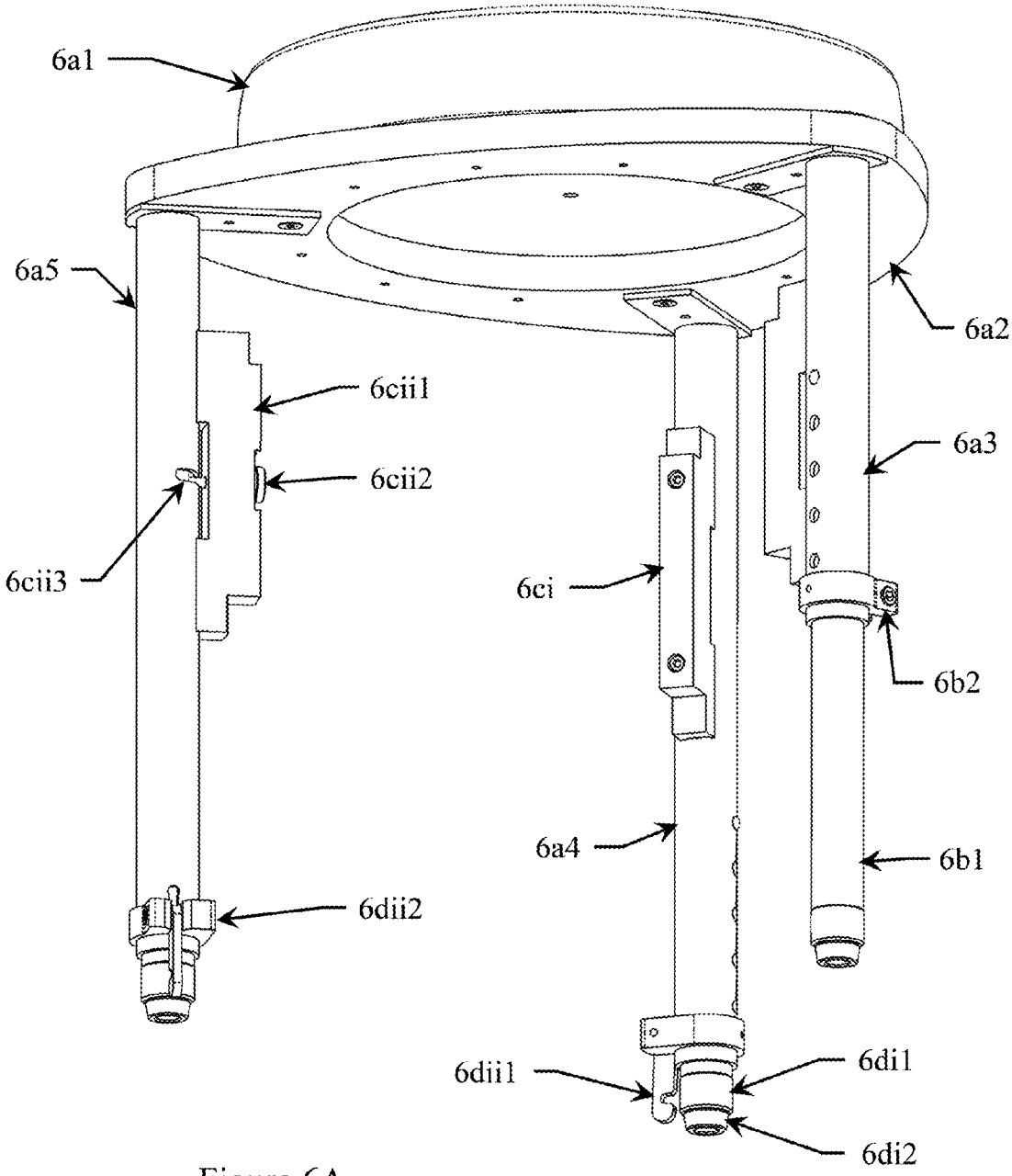
FIG. 6A is a perspective view from below of an embodiment of a throne assembly of the compact drum set.
Figure 6B:
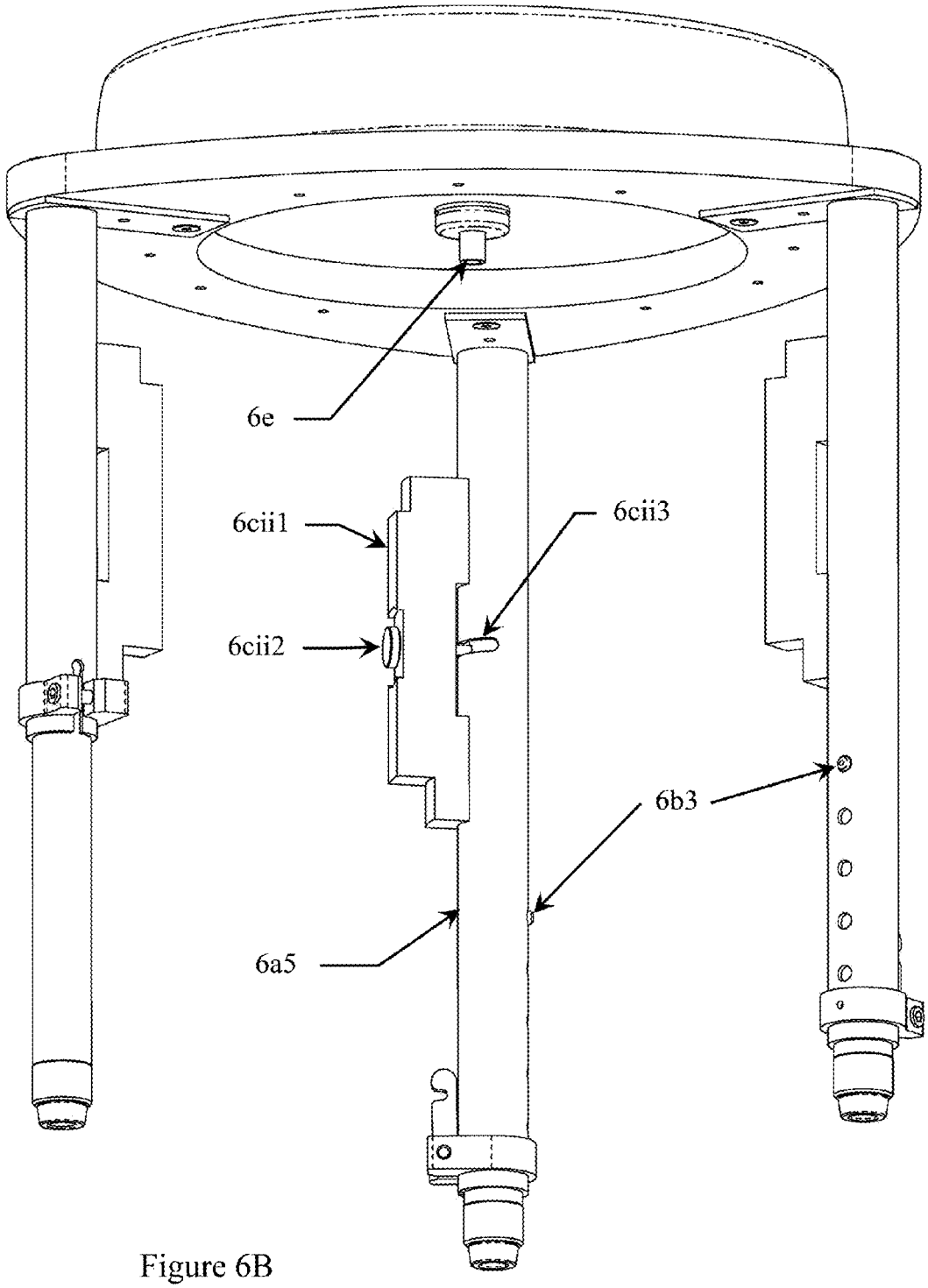
FIG. 6B is a perspective view of the embodiment of a throne assembly of the compact drum set, in an articulated mode.

6. With reference to FIGS. 6A-6B, an embodiment of the Throne Assembly of the compact drum set will be described:

a. A padded platform (6*a*1) for sitting, attached to a planar element (6*a*2) attached to 3 parallel legs (6*a*3, 6*a*4, 6*a*5).

b. Legs (6*a*3, 6*a*4, 6*a*5) contain telescoping lower legs (6*b*1). Clamps (6*b*2) and/or detent buttons (6*b*3) fix the extended lengths of the legs.

c. For transport and storage (see Parts 9 and 10), Floor Tom with Tom Tom (Parts 5 & 4 together) can be stowed between legs (6*a*3, 6*a*4, 6*a*5), and are constrained by 3 or more members:

i. 2 or more fixed bracket members (6.*ci*) are attached to legs (6*a*3, 6*a*4). These brackets mate and constrain the surfaces of and between the annular members (Parts 5*a*2 and 5*c*2) of the Floor Tom.

ii. 1 swing bracket member (6*cii*1) is fastened to leg (6*a*5) by a thumb-screw (6*cii*2) through a horizontal radial slot (6*cii*3) threading into a radial threaded hole in a cylindrical slug which can move rotationally inside the leg (6*a*5) tube. Tightening the thumb-screw (6*cii*2) fixes the alternately open (FIG. 6B) or closed (FIG. 6A) position of the swing bracket.

d. The Throne, together with the Bass Drum assembly (part 1), defines the product envelope; they contain and protect components of the Drum Set, in the stowed configuration (see Parts 9 and 10).

i. Lower legs (6*b*1) fit loosely into columns (Parts 1*qi*, 1*qii*, 1*qiii*). Their fit is guided by plastic bushings (6*di*1) which attach to the leg ends (6*b*1) and to which are attached elastomeric feet (6*di*2).

ii. Clamps (6*b*2) attached to 2 legs (6*a*4, 6*a*5) constrain a latch (6*dii*1), which can rotate freely about each clamp bolt axis (6*dii*2). The notched tips of each latch (6*dii*1) mate and engage a bolt holding a clamp (Part 1*qiv*) near the end of support columns (Parts 1*qi*, 1*qiii*) of the Bass Drum assembly. The engagement of the bolts (Part 1*qiv*) with the notches in tips (6*dii*1) connects the Throne to the Bass Drum and allows the Drum Set to be handled as a single unit.

e. Hi-Hat and other Cymbals can be secured together under the seat (6*a*1) for transport and storage. An inverted cymbal support bushing (6*e*) with felt washers protects the cymbal center-bores from damage by the fastener (see Part 9)

Figure 7A:
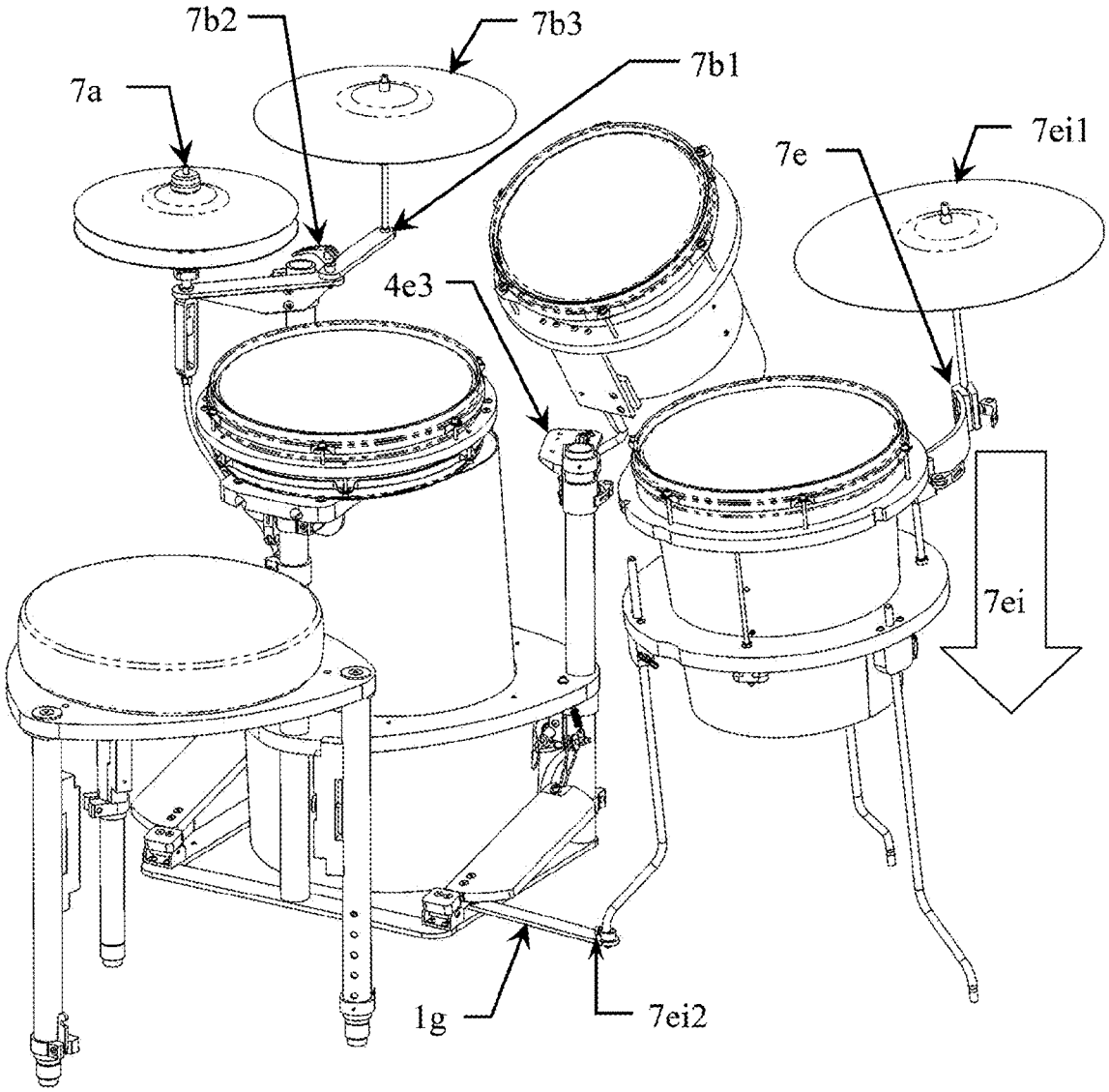
FIG. 7A is a perspective view of an embodiment of the compact drum set in a set-up mode.

7. With reference to FIG. 7A, embodiments of Tertiary Percussion Instrument Support Assemblies of the compact drum set will be described: Tertiary instruments such as cymbals (splash crash, ride etc.), and other instruments, such as small drums, bells, chimes, tambourine, etc, can be mounted to:

a. The Hi-Hat pull rod (Part 3*a*4) end (7*a*).

b. A beam (7*b*1) attached with a cam closure (7*b*2) to the Hi-Hat beam (Part 3.*e*2), shown supporting a Crash Cymbal (7*b*3).

c. The Tom Tom clamp beam (Part 4*e*3).

d. A tertiary clamp and/or beam attached to any or all support columns (Parts 1*qi*1, 1*qii*1, 1*qiii*1).

e. A tertiary beam (7*e*) attached to Floor Tom annular members (Parts 5*a*2, 5*c*2) or to rod(s) (Part 5*cd*).

i. Tipping moment (7*ei*) caused by off-center loading of a heavy instrument such as a Ride Cymbal (7*ei*1) may be mitigated by an extensible brace (Part 1*g*) affixed by a Thumb screw (7*ei*2) to a notch near the end of a Floor Tom leg (Part 5*h*) opposite the beam (7*e*).

Figure 8A:
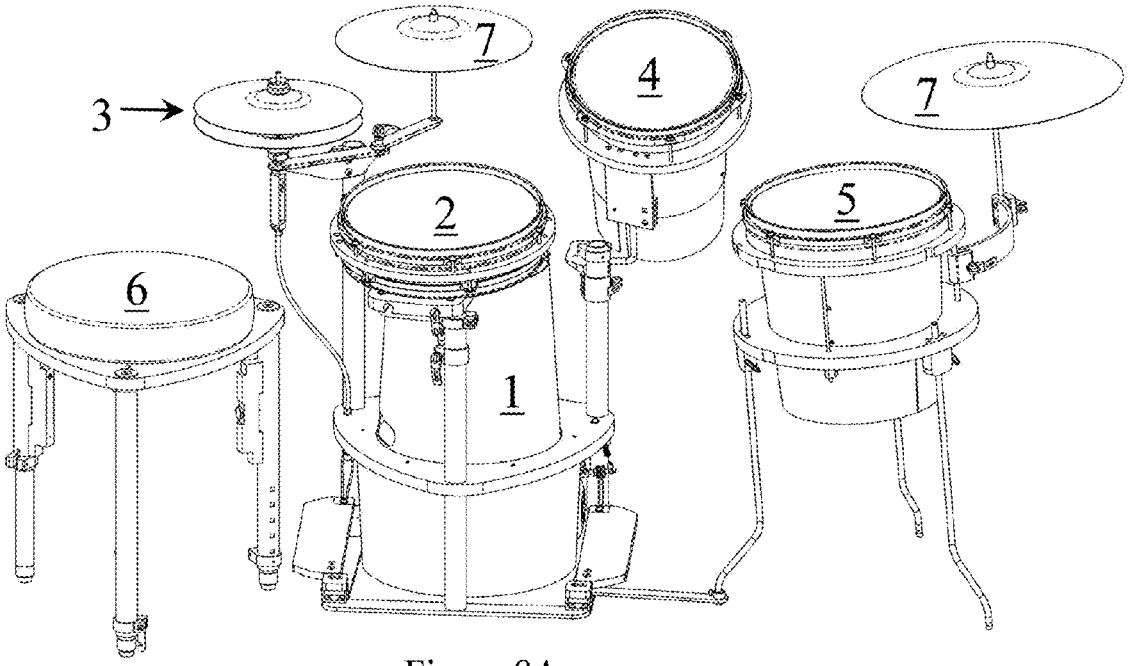
FIG. 8A is an alternate perspective view of an embodiment of the compact drum set in a set-up mode.

8. With reference to FIG. 8A, an embodiment of the compact drum set in a set-up mode of assembly will be described: Instruments position in commonly used trap kit configurations, with adjustability of height, angle and spatial orientation. Instruments can be moved and re-positioned to accommodate left-handed or mixed playing styles.

Figure 9A:
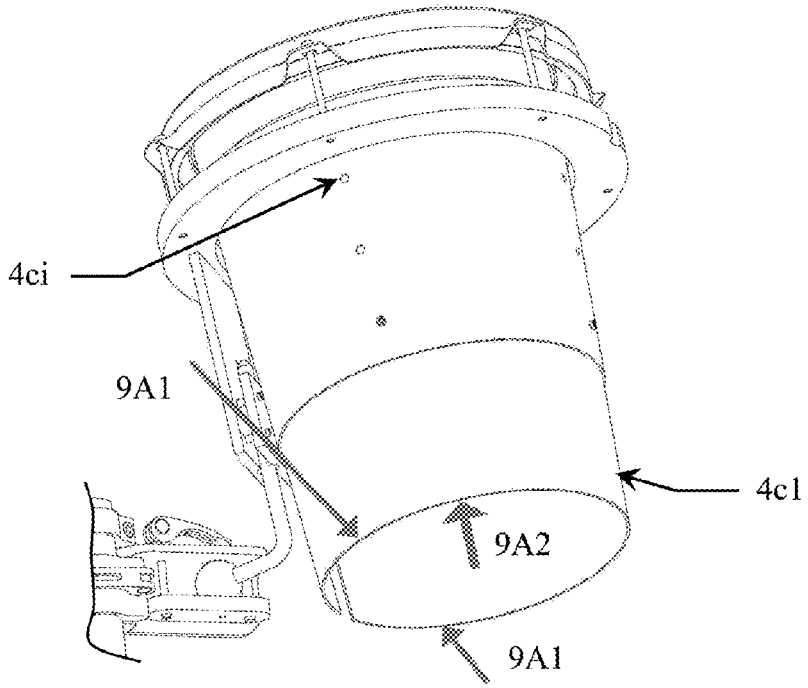
FIG. 9A is a perspective view of an embodiment of a tom tom assembly of the compact drum set, with sleeve extended.
Figure 9B:
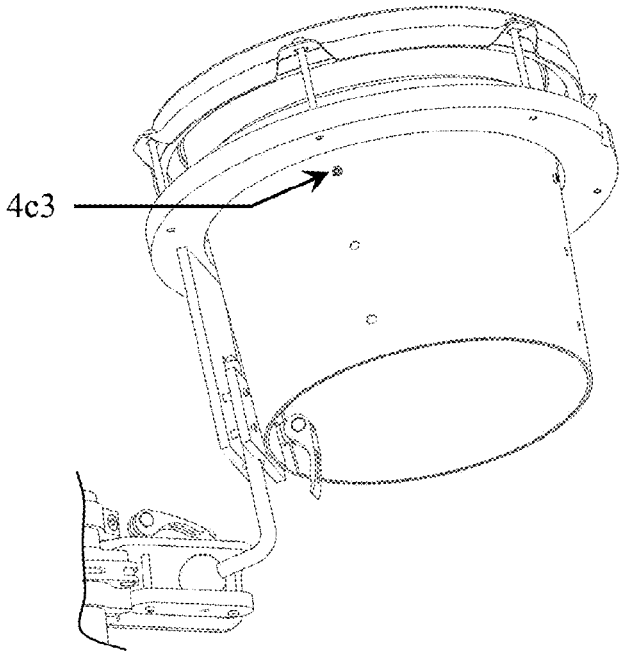
FIG. 9B is a perspective view of an embodiment of a tom tom assembly of the compact drum set, with sleeve retracted.
Figure 9C:
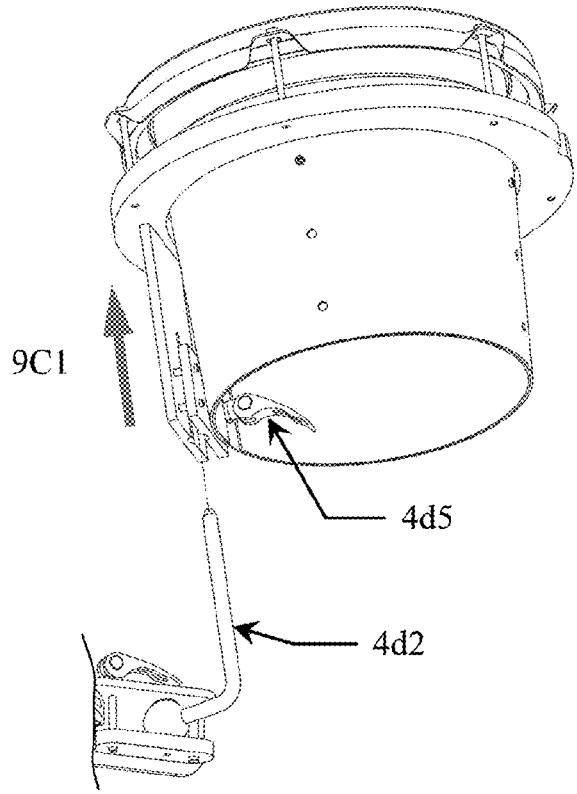
FIG. 9C is a perspective view of an embodiment of a tom tom assembly of the compact drum set, as separated from its mounting support.
Figure 9F:
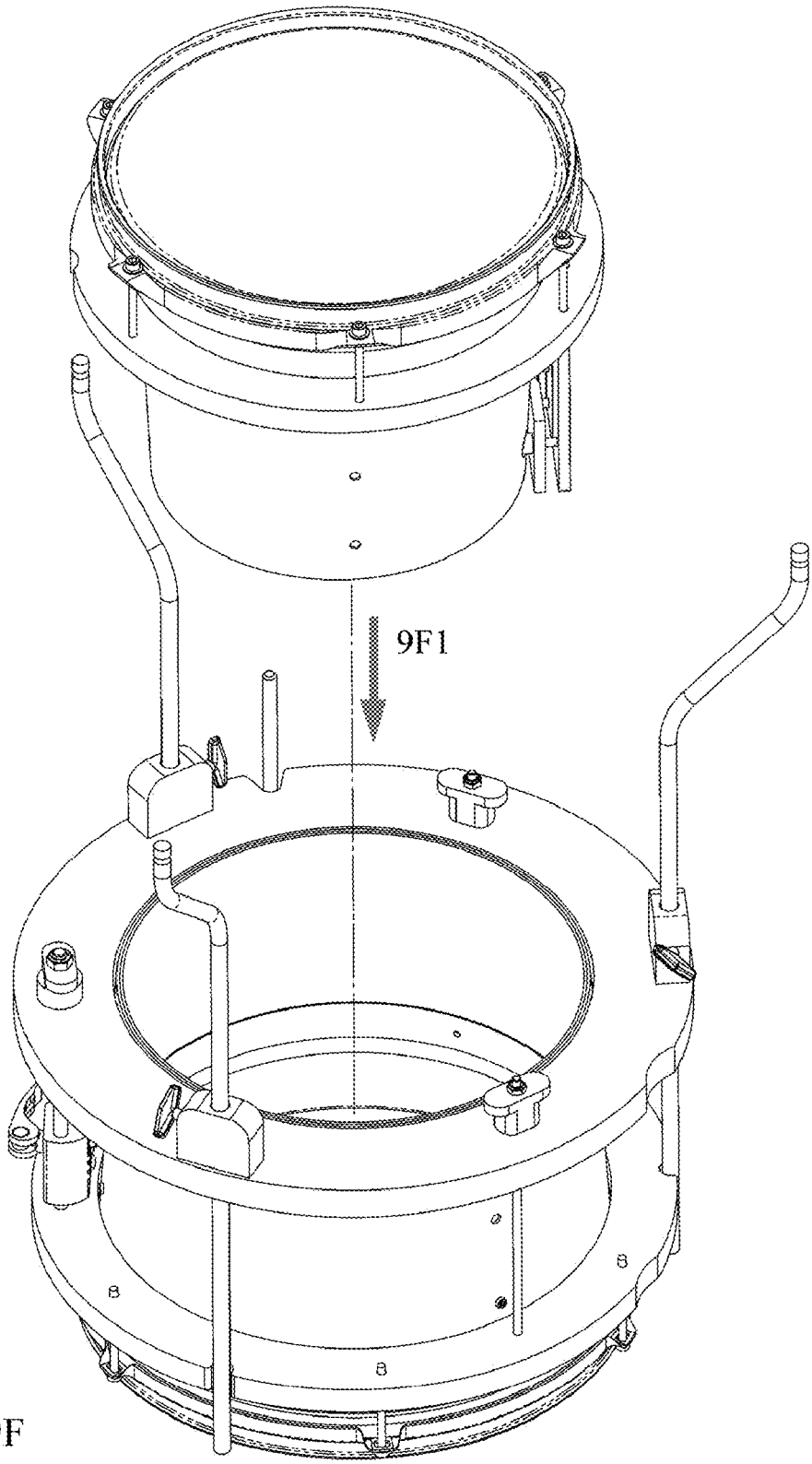
FIG. 9F is a perspective view of an embodiment of a floor tom and tom tom sub-assembly of the compact drum set.
Figure 9G:
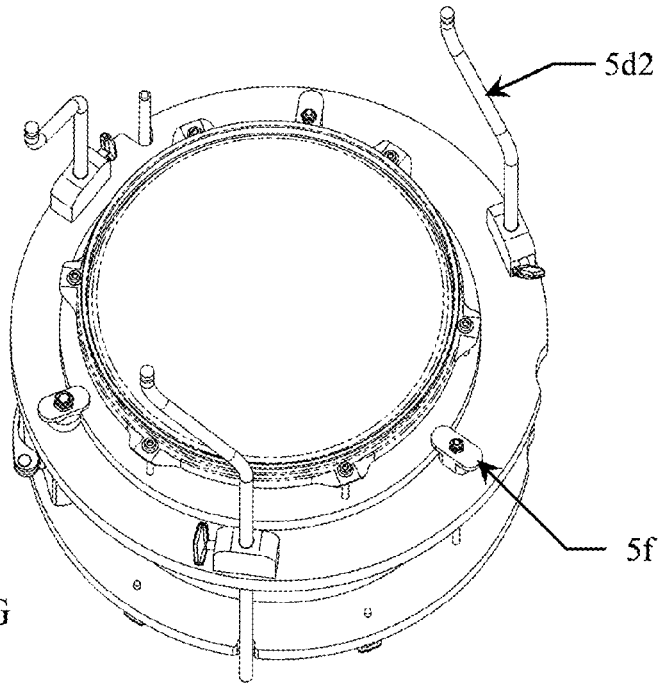
FIG. 9G is a top perspective view of an embodiment of a floor tom and tom tom sub-assembly of the compact drum set with assembly clips engaged.
Figure 9H:
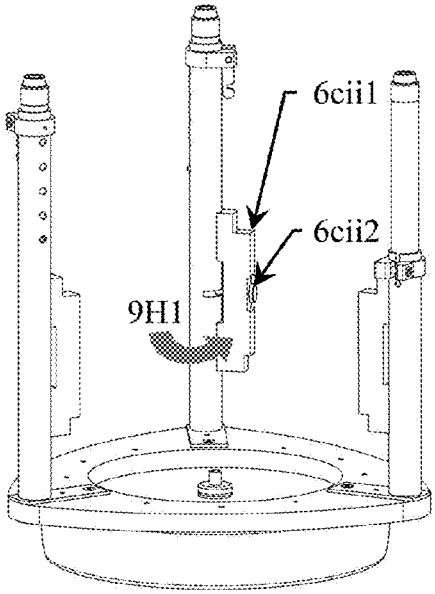
FIG. 9H is a perspective view of an embodiment of an inverted throne assembly of the compact drum set.
Figure 9I:
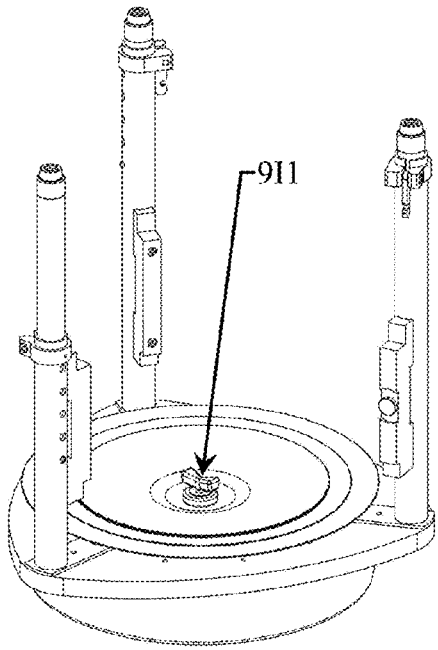
FIG. 9I is a perspective view of an embodiment of an inverted throne with cymbals sub-assembly of the compact drum set.
Figure 9J:
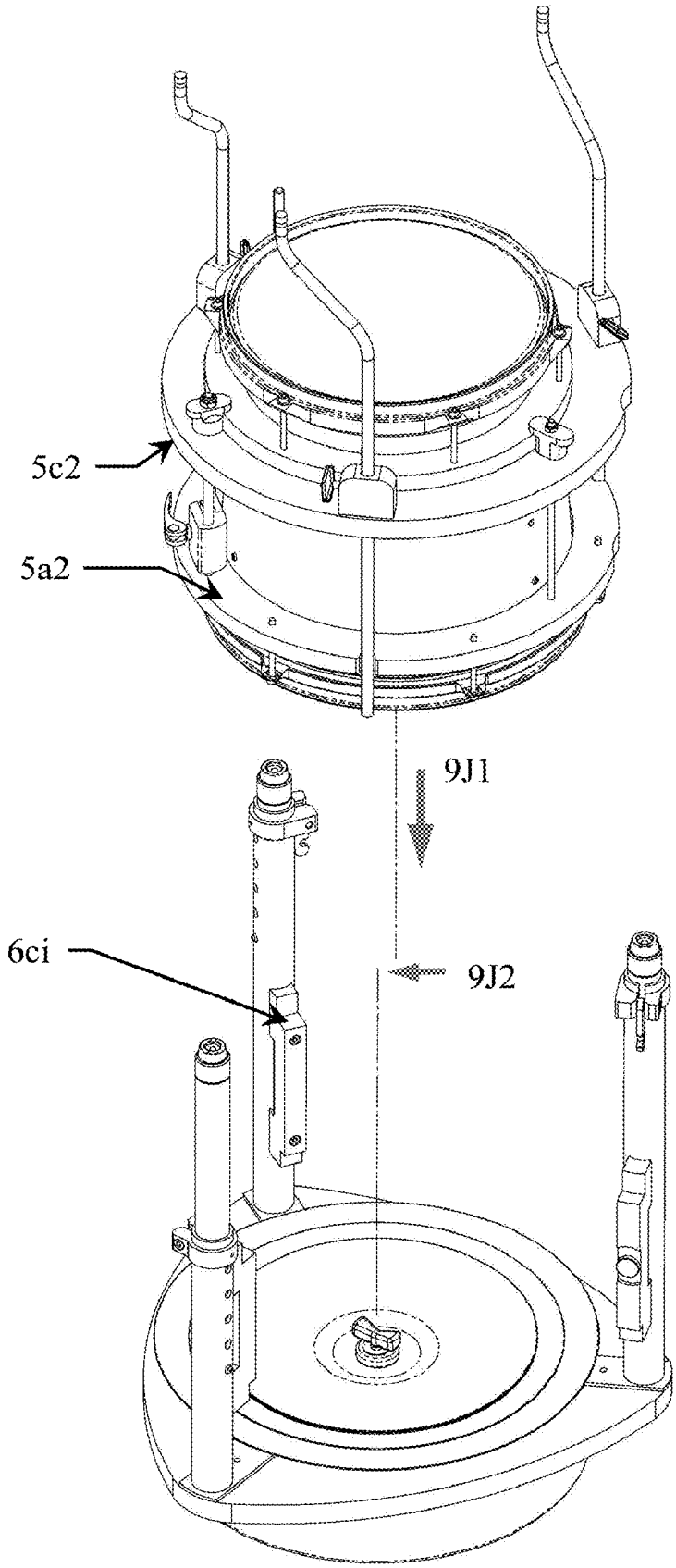
FIG. 9J is a perspective view of an embodiment of an inverted throne, cymbals, floor tom and tom tom sub-assembly of the compact drum set.
Figure 9K:
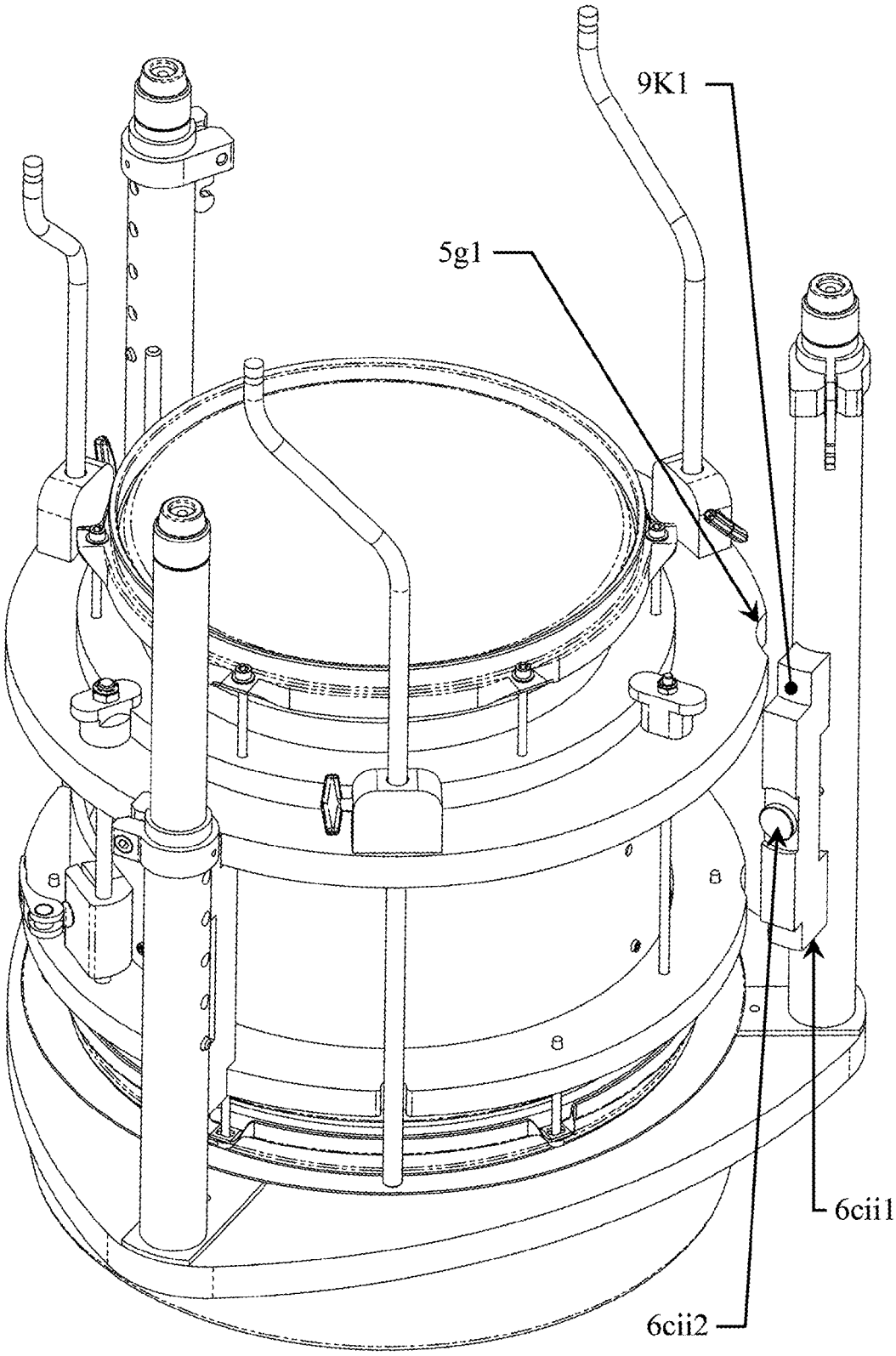
FIG. 9K is a perspective view of an embodiment of an inverted partial assembly of the compact drum set, in compact mode with articulated bracket.
Figure 9L:
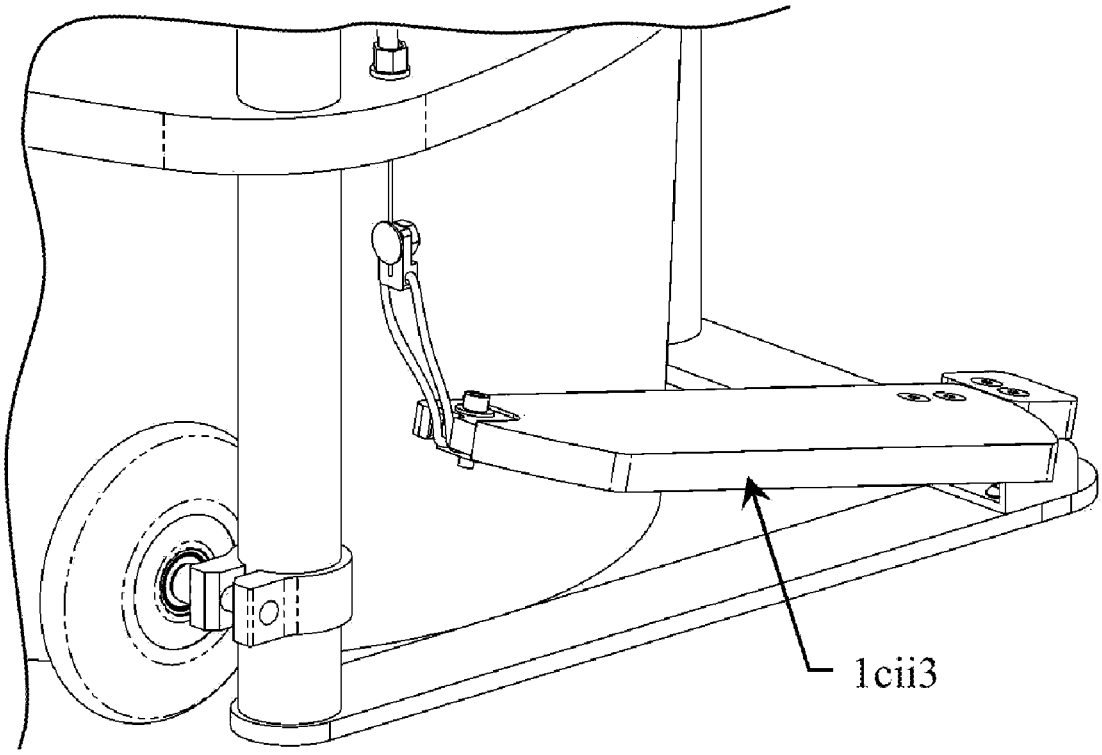
FIG. 9L is a perspective view of an embodiment of a pedal assembly of the compact drum set, in a set-up mode.
Figure 9M:
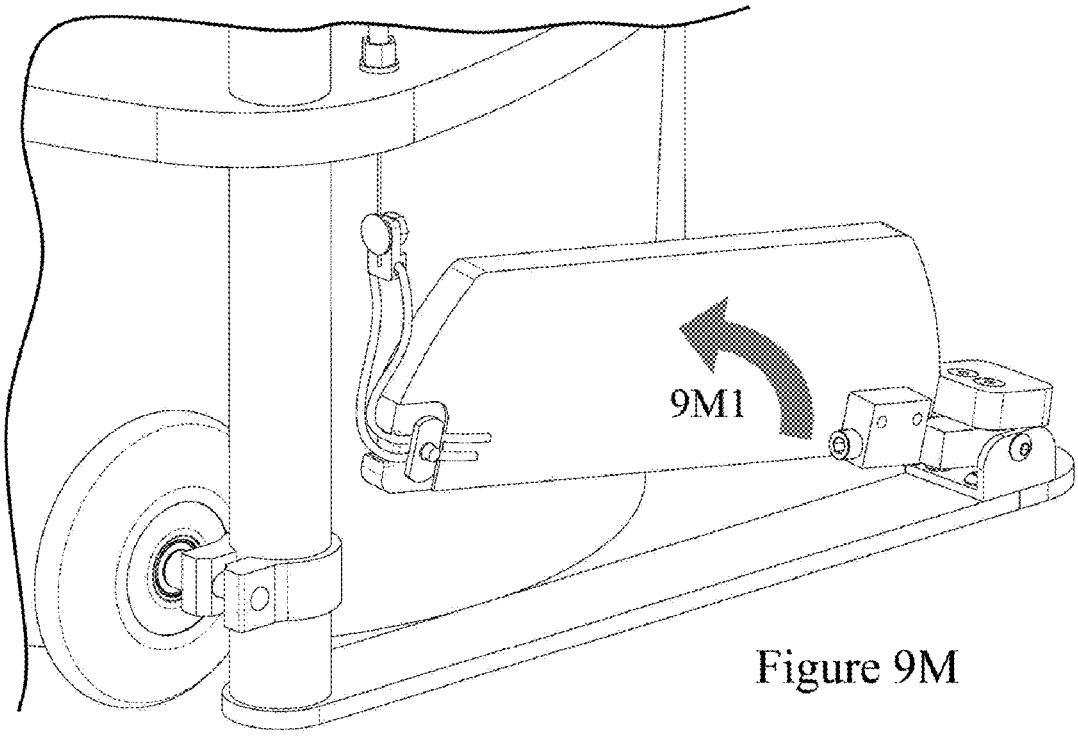
FIG. 9M is a perspective view of an embodiment of a pedal assembly of the compact drum set, in a compact mode.
Figure 9N:
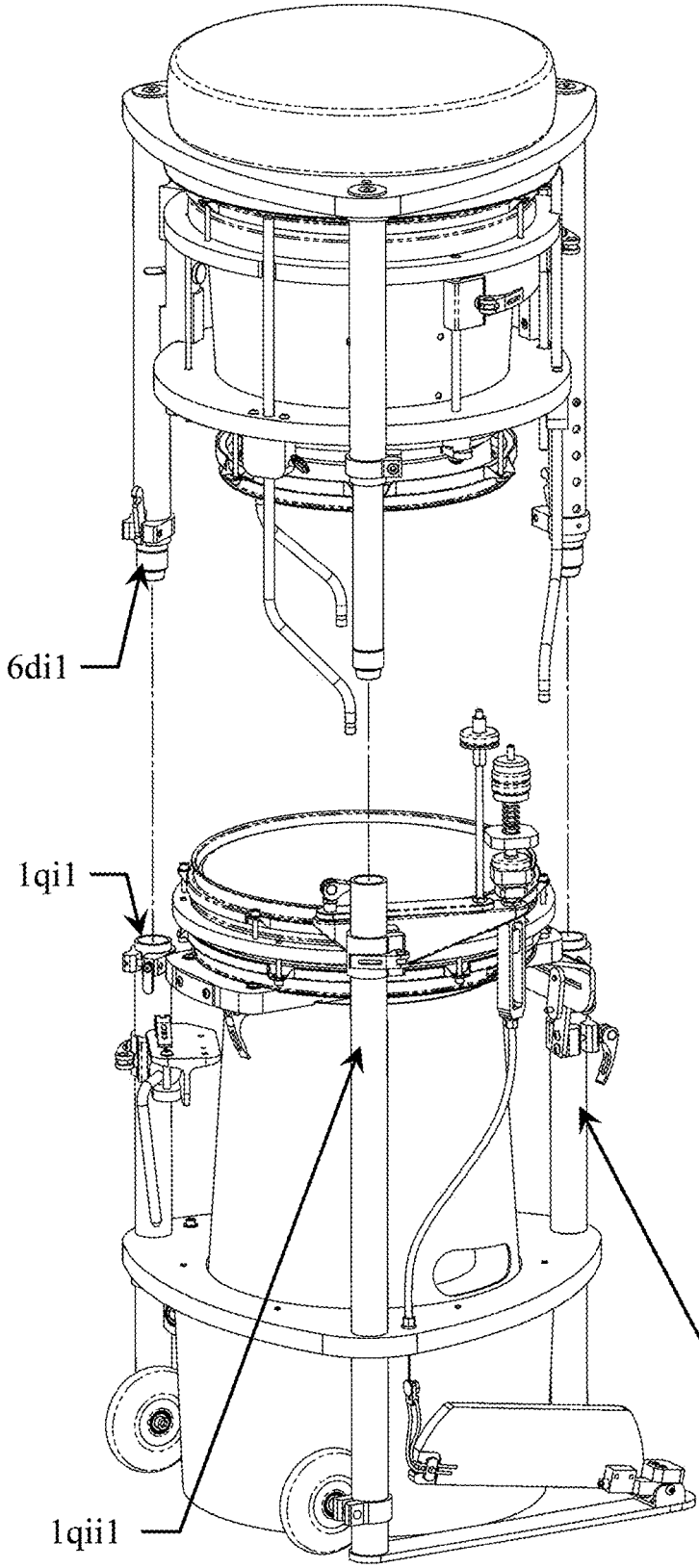
FIG. 9N is a perspective exploded view of an embodiment of the compact drum set, in a compact mode.
Figure 9O:
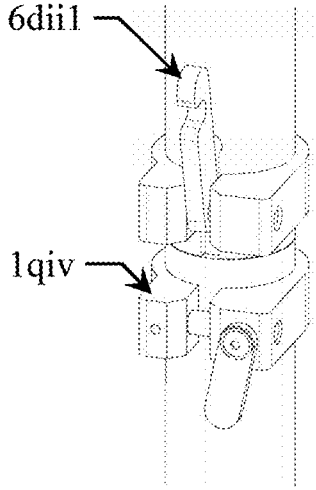
FIG. 9O is a perspective view of an embodiment of a latch and clamp assembly of the compact drum set, in an unlocked configuration.
Figure 9P:
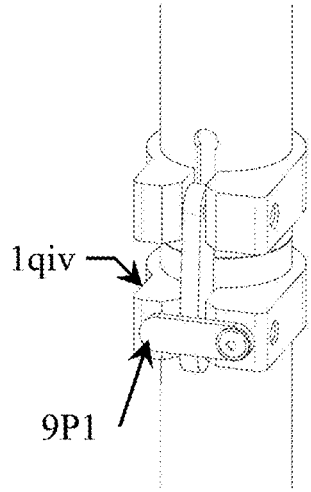
FIG. 9P is a perspective view of an embodiment of a latch and clamp assembly of the compact drum set, in a locked configuration.

1) Bass Drum
2) Snare Drum.
3) Hi Hat
4) Tom Tom
5) Floor Tom
6) Throne
7) Tertiary Instruments 9. With reference to FIGS. 9A-9P, steps in a method of stowing an embodiment of the compact drum set into a compact mode of assembly will be described, beginning with the compact drum set in a set-up mode of assembly: (a method of setting up will reverse the following actions:)

9A. Apply radial inward pressure (9A1) to Tom Tom sleeve (4*c*1), simultaneously pushing the sleeve axially up (9A2) into the drum.

9B. Allow fastener heads (4*c*3) to settle into the top row of holes.

9C. Release the cam closure (4*d*5) and lift (9C1) the Tom Tom from the spike member (4*d*2).

9D. Remove and stack cymbals from Hi-Hat (Part 3) and tertiary (Part 7) assemblies. Lower and/or withdraw the extended positions and orientations of Snare planar member (2*f*1), Hi-Hat beam (3*e*2), Tertiary cymbal supports (7*b*1 and 7*e*) and Tom Tom spike and clamp (4*d*2 and 4*f*1). Apply radial inward pressure (9D1) to Floor Tom sleeve (5*e*1), simultaneously pushing the sleeve axially up (9D2) into the drum. Mate flexure fastener heads into the top row of holes (5*ei*).

9E. Loosen thumb screw of extensible brace (7*ei*2). Remove and invert (9E1) Floor Tom, and retract legs (5*d*2). Align brace (7*ei*2) to kick pedal brace (part 1*ci*2).

9F. Orient as shown and lower (9F1) Tom Tom (Part 4) into Floor Tom (Part 5).

9G. Orient legs (5*d*2) and clips (5*f*) as shown.

9H. Invert Throne (Part 6). Loosen thumb-screw (6*cii*2) and open (9H1) swing bracket (6*cii*1).

9I. Place cymbals into throne as shown. Secure to throne using felt washer and wing-bolt (9I1).

9J. Orient and lower (9J1) Toms (Parts 4 and 5 together) into Throne (Part 6) as shown. Align (9J2) center axes, mating the Throne fixed brackets (6*ci*) vertically between Floor Tom annular members (5*a*2 and 5*c*2).

9K. Close the Throne swing bracket (6*cii*1), mating its curved faces (9K1) onto Floor Tom annular member notches (5*g*1). Tighten thumb screw (6*cii*2) of the Throne swing bracket.

9L. Grasp Hi-Hat Pedal 1*cii*3) and rotate it into a vertical orientation.

9M. Grasp the Kick Pedal and rotate into a vertical orientation, in mirror image to the Hi-Hat Pedal rotation (9M1) shown.

9N. Orient (invert) and assemble the Throne and Toms (Parts 4, 5 and 6) onto the Bass Drum assembly (Part 1) as shown. Insert Throne leg bushings (6*di*1) into corresponding open ends of support columns (1*qii*1, 1*qi*1 and 1*qiii*1).

9O. Lower Throne Leg Clamp Latches (6*dii*1) to mate and engage corresponding bolts of clamps (1*qiv*).

9P. Orient hasps (9P1) on clamps (1*qiv*) to secure the assembly.

Figure 10A:
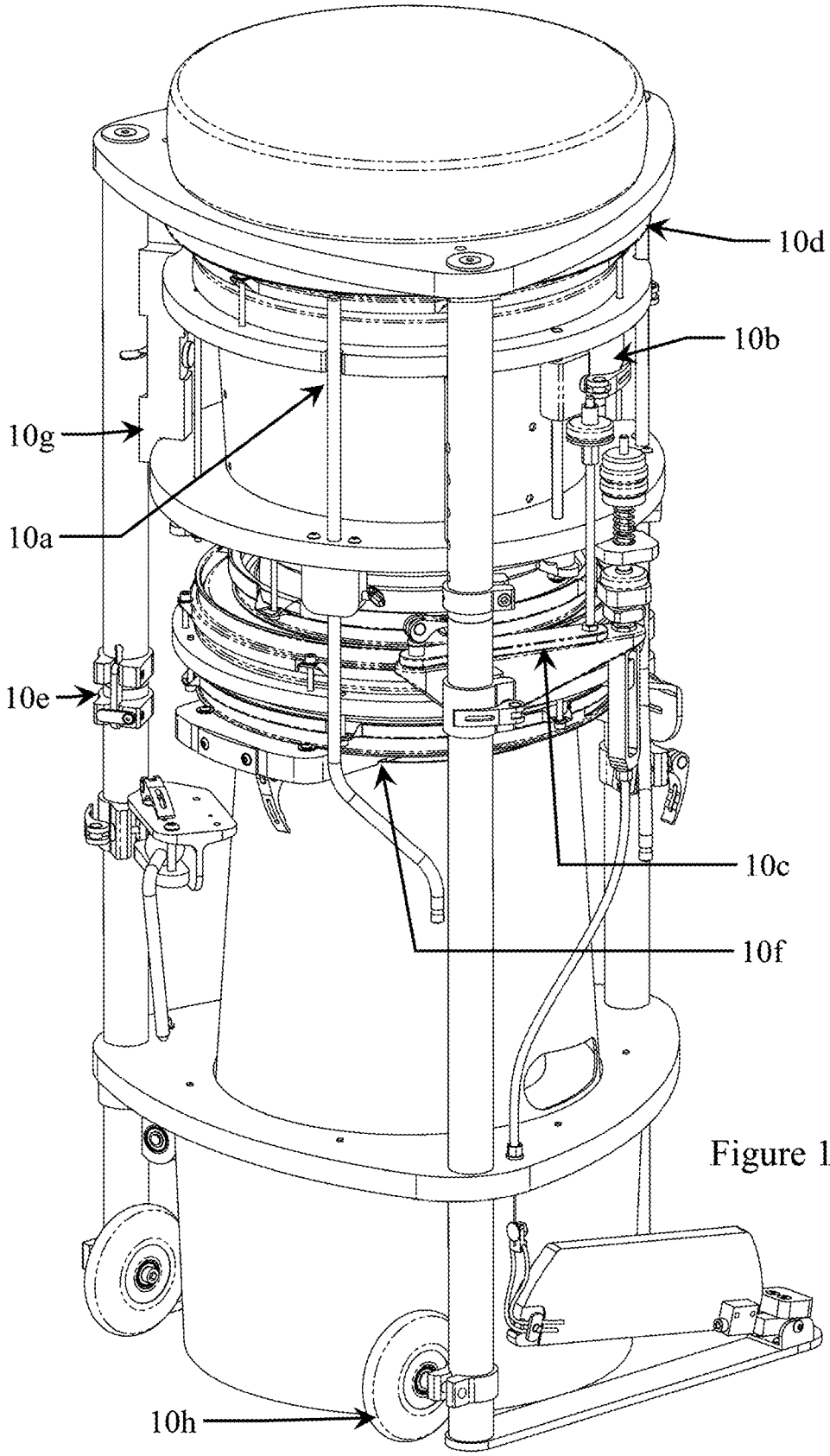
FIG. 10A is a perspective view of an embodiment of the compact drum set.

10. With reference to FIG. 10A, an embodiment of the compact drum set in a compact mode of assembly will be described: components are articulated for transport and storage: Instruments nest and stack in a single column, storing all instruments, hardware, cymbals and throne in a volume of approximately 7.0 $ft^3$, or 0.20 $m^3$.

a. Floor Tom legs extend through annular member, minimizing length.

b. Tertiary (Ride cymbal) beam rotates to stow behind Floor Tom leg.

c. Tertiary (Crash cymbal) beam rotates to stow with Hi-Hat support beam.

d. Cymbals stow beneath the seat of the Throne.

e. Latch tips on Throne leg clamps engage clamps at Bass Drum support column ends.

f. Grooves in Snare support planar member constrain the Snare centered to the Bass Drum.

g. Brackets constrain Floor Tom with Tom Tom to Throne legs.

h. Casters enable rolling transport.

System Applications—the Invention is useful for any of the following environments or users:

I. Professional engagements—the compact drum set saves time and effort to transport and deploy drums at:

a. Night clubs—at downtown bars with limited bandstand areas.

b. Private parties—at a restaurants, homes, hotels or social halls.

c. Public events—concerts at parks, amphitheaters, street festivals, etc.

II. Home studios—the compact drum set fits in space-limited rehearsal and/or recording areas in musicians' homes and apartments.

III. Children and students—the compact drum set fits easily into a bedroom, dorm room, classroom or storage closet; plays at moderate volume, compared to a conventional set.

Improvements—the following are some, but not all, of the improvements of the compact drum set over what was done before:

1. The use of commonly available lightweight formed metal or molded plastic pails as shells with conventional drum hoops and heads, using the reinforcements near the shell rims to oppose the annular member through which the lugs are fastened. It is not necessary to alter the shell to fit it with a head.

2. The use of annular members with wood or composite (resin-fiber) drum shells, obviating conventional metal drum hardware, resulting in reduced weight and/or manufacturing costs, and allowing set-up and compact configurations herein described.

3. The use of telescoping tubular members with connecting clamps and beams to constitute and support drum hardware, including a throne, functioning in both usage and storage modes.

4. A drum throne capable of holding and protecting cymbals, toms and other hardware, and of interlocking with other hardware to form and protect the drum set as a single compound object.

5. Drum set which stows and handles in a form similar to a hand truck, with parallel wheels at one end of the bottom, and support members also functioning as handles.

6. The use of a tubular member to adjustably support a Bass Drum batter mechanism.

7. Batter mechanisms adjustable by common threaded rod and jam-nuts.

8. A Bass Drum resonant port constructed after a transmission-line speaker enclosure, using nesting tubes or frustra with helical walls formed or cut from a high profile of pliable foam material.

9. A compression Hi Hat spring positioned completely between the cymbals, adjusted by nuts threaded over a pipe, between and below the cymbals.

10. Hi Hat support capable of theta and z-axis adjustment with a fixed-position base, keeping the foot pedal location constant.

11. Snare drum support is capable of 2-axis orientation adjustment, as well as adjustment of lateral position and height (see Part 2 illustrations).

12. Tom Tom with adjustable telescoping sleeve, held assembled by a flexure.

13. Floor Tom with an adjustable telescoping sleeve, held assembled by a flexure.

14. Floor Tom structurally supported by a pair of annulae connected by rods.

The above figures may depict exemplary configurations for the invention, which is done to aid in understanding the features and functionality that can be included in the invention. The invention is not restricted to the illustrated architectures or configurations, but can be implemented using a variety of alternative architectures and configurations. Additionally, although the invention is described above in terms of various exemplary embodiments and implementations, it should be understood that the various features and functionality described in one or more of the individual embodiments with which they are described, but instead can be applied, alone or in some combination, to one or more of the other embodiments of the invention, whether or not such embodiments are described and whether or not such features are presented as being a part of a described embodiment. Thus the breadth and scope of the present invention, especially in the following claims, should not be limited by any of the above-described exemplary embodiments.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although item, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

I claim:

1. A compact transportable drum set, comprising:

a bass drum;

a snare drum;

at least one tom drum;

at least one cymbal;

a throne, wherein the compact transportable drum set is compactable to a compact transportable single package with the bass drum, the snare drum, at least one tom drum, at least one cymbal, and the throne vertically aligned and defining an envelope volume less than 8 cubic feet and weighing less than 60 lbs.

2. The compact transportable drum set of claim 1, wherein the at least one cymbal includes a high hat and a crash cymbal.

3. The compact transportable drum set of claim 1, wherein the at least one tom includes a floor tom and a tom tom.

4. The compact transportable drum set of claim 1, wherein the throne includes a plurality of supports with two supports having fixed brackets and one support having a movable bracket, the fixed brackets and movable brackets securing the at least one tom between the plurality of supports of the throne when the compact transportable drum set is in the transportable single package.

5. The compact transportable drum set of claim 1, wherein the bass drum, the snare drum, at least one tom drum, at least one cymbal, and the throne defining an envelope volume less than 7 cubic feet and weighing less than 50 lbs.

6. The compact transportable drum set of claim 1, wherein the bass drum, the snare drum, at least one tom drum, at least one cymbal, and the throne include vertically aligned centers.

7. The compact transportable drum set of claim 1, wherein in the transportable single package the at least one tom is carried within the throne.

8. The compact transportable drum set of claim 7, wherein the at least one tom includes a floor tom and a tom tom disposed within the floor tom.

9. The compact transportable drum set of claim 1, wherein in the transportable single package the snare drum is carried on top of the bass drum.

10. The compact transportable drum set of claim 1, wherein in the transportable single package the throne and the bass drum form a support structure for the compact transportable drum set.

11. The compact transportable drum set of claim 10, wherein in the transportable single package the throne includes a plurality of supports and the bass drum includes a plurality of supports that couple to the plurality of supports of the throne to form the support structure for the compact transportable drum set.

12. The compact transportable drum set of claim 11, wherein at least one of the plurality of supports of the bass drum include a lower end with at least one wheel, and in the transportable single package the compact transportable drum set forms a hand truck.

13. The compact transportable drum set of claim 1, wherein the throne includes a seat with an underside, and the at least one cymbal is disposed within the underside of the seat of the throne.

14. The compact transportable drum set of claim 1, wherein the at least one tom drum includes an extendable sleeve member adjustable for adjusting pitch in the at least one tom drum.

15. The compact transportable drum set of claim 1, further including at least one ball joint and an elongated slot that receives the ball joint for at least 2-axis adjustment as well as adjustment of lateral position and height of the at least one tom drum and the snare drum.

16. The compact transportable drum set of claim 1, wherein the bass drum includes a duct port and an interior with a curvilinear duct in communication with the duct port to form a transmission line in the bass drum.

17. The compact transportable drum set of claim 1, wherein the compact transportable drum set is made of one or more of wood, plastic, composite, and metal.

18. The compact transportable drum set of claim 1, wherein the at least one cymbal includes at least two cymbals with a compression spring there between and a pull line coupled to at least one of the at least two cymbals.

19. The compact transportable drum set of claim 1, wherein at least one of the bass drum, the snare drum, and the at least one tom drum include one or more annular members with at least one of a wood drum shell and a composite drum shell.

20. A method of compacting and transporting the compact transportable drum set of claim 1, comprising:

providing a bass drum, a snare drum, at least one tom drum, at least one cymbal, and a throne, compacting the bass drum, the snare drum, the at least one tom drum, the at least one cymbal, and the throne into the transportable single package by providing the at least one tom drum and the at least one cymbal, providing the snare drum on the bass drum, and coupling the throne to the bass drum;

transporting the compact transportable drum set with the compact transportable drum set in the transportable single package.

* * * * *